US007355169B2

(12) United States Patent
McLuckey et al.

(10) Patent No.: US 7,355,169 B2
(45) Date of Patent: Apr. 8, 2008

(54) METHOD OF SELECTIVELY INHIBITING REACTION BETWEEN IONS

(75) Inventors: Scott A. McLuckey, West Lafayette, IN (US); Gavin E. Reid, Lafayette, IN (US); James Mitchell Wells, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 147 days.

(21) Appl. No.: 11/418,907

(22) Filed: May 5, 2006

(65) Prior Publication Data

US 2006/0219898 A1 Oct. 5, 2006

Related U.S. Application Data

(62) Division of application No. 10/485,807, filed on Feb. 4, 2004, now Pat. No. 7,064,317.

(60) Provisional application No. 60/312,574, filed on Aug. 15, 2001.

(51) Int. Cl.
*H01J 49/00* (2006.01)

(52) U.S. Cl. ..... 250/282; 250/288; 250/292; 250/281; 250/283; 250/285; 250/489

(58) Field of Classification Search ..... None
See application file for complete search history.

(56) References Cited

U.S. PATENT DOCUMENTS 6,087,658 A 7/2000 Kawato 6,674,067 B2 1/2004 Grosshans

FOREIGN PATENT DOCUMENTS

EP EP 0 793 256 A1 9/1997

OTHER PUBLICATIONS

R. E. March et al., "Practical Aspects of Ion Trap Mass Spectrometry", vol. I—Fundamentals of Ion Trap Mass Spectrometry, Chapter 2—Theory of Quadrupole Mass Spectrometry, *CRC Press*, 1995, pp. 25-48.

R. E. March et al., "Practical Aspects of Ion Trap Mass Spectrometry", vol. I—Fundamentals of Ion Trap Mass Spectrometry, Chapter 3—Nonlinear Ion Traps, *CRC Press*, 1995, pp. 49-167.

(Continued)

*Primary Examiner*—Jack I. Berman
*Assistant Examiner*—Zia R. Hashmi
(74) *Attorney, Agent, or Firm*—Barnes & Thornburg LLP

(57) ABSTRACT

A method of inhibiting the reaction between ions of opposite polarity is disclosed. The method includes exposing a population of ions to a resonance excitation frequency during a mass-to-charge altering reaction between a first subpopulation of ions and a second subpopulation of ions, the resonance excitation frequency being tuned to inhibit the mass-to-charge altering reaction between an ion of the first subpopulation of ions having a predetermined mass-to-charge ratio and an ion of the second subpopulation of ions so that when an ion of the first subpopulation of ions attains the predetermined mass-to-charge ratio, the ion having the predetermined mass-to-charge ratio is selectively inhibited from reacting with ions of the second subpopulation of ions.

5 Claims, 14 Drawing Sheets

OTHER PUBLICATIONS

R. E. March et al., "Practical Aspects of Ion Trap Mass Spectrometry", vol. I—Fundamentals of Ion Trap Mass Spectrometry, Chapter 4—Commercialization of the Quadrupole Ion Trap, *CRC Press*, 1995, pp. 169-205.

R. E. March et al., "Practical Aspects of Ion Trap Mass Spectrometry", vol. II—Ion Trap Instrumentation, Chapter 1—High Mass, High Resolution Mass Spectrometry, *CRC Press*, 1995, pp. 3-47.

McLuckey, SA et al. "Electrospray and the Quadrupole Ion Trap" In "Practical Aspects of Ion Trap Mass Spectrometry", vol. II—Ion Trap Instrumentation, RE March & JFJ Todd (Eds.), *CRC Press*, 1995, pp. 89-14.

R. R. O. Loo et al., "A New Approach for the Study of Gas-Phase Ion-Ion Reactions Using Electrospray Ionization", *J. Am Soc. Mass Spectrom*, 1992, vol. 3, pp. 695-705.

J. B. Fenn et al., "Electrospray Ionization for Mass Spectrometry of Large Biomolecules", *Science*, 1989, vol. 246, No. 4926, pp. 64-71.

S. J. Gaskell, "Electrospray: Principles and Practices", *Journal of Mass Spectrometry*, 1997, vol. 32, pp. 677-688.

J. F. Mahoney et al., "Massive Cluster Impact Mass Spectrometry: A New Desorption Method for the Analysis of Large Biomolecules", *Rapid Commun. Mass Spectrom*, 1991, vol. 5, pp. 441-445.

M. Karas et al., "Laser Desorption Ionization of Proteins with Molecular Masses Exceeding 10000 Daltons", *Anal. Chem.*, 1988, vol. 60, No. 20, pp. 2299-2301.

M. Karas et al., "Ionization in matrix-assisted laser desorption/ionization: singly charged molecular ions are the lucky survivors", *J. Mass Spectrom*, 2000, vol. 35, pp. 1-12.

J. L. Stephenson, Jr. et al., "Ion/Ion Proton Transfer Reactions for Protein Mixture Analysis", *Anal. Chem.*, 1996, vol. 68, No. 22, pp. 4026-4032.

J. L. Stephenson, Jr. et al., "Ion/Ion Reactions for Oligopeptide Mixture Analysis: Application to Mixtures Comprised of 0.5—100 kDa Components", *J. Am. Soc. Mass Spectrom*, 1998, vol. 9, pp. 585-596.

J. L. Stephenson, Jr. et al., "Charge Manipulation for Improved Mass Determination of High-mass Species and Mixture Components by Electrospray Mass Spectrometry", *J. Mass Spectrom*, 1998, vol. 33, pp. 664-672.

D. E. Clemmer et al., "Ion Mobility Measurements and their Applications to Clusters and Biomolecules", *Journal of Mass Spectrometry*, 1997, vol. 32, pp. 577-592.

R. D. Smith et al., "Trapping, detection and reaction of very large single molecular ions by mass spectrometry", *Nature*, 1994, vol. 369, pp. 137-139.

S. A. McLuckey et al., "Ion/Molecule Reactions for Improved Effective Mass Resolution in Electrospray Mass Spectrometry", *Anal. Chem.*, 1995, vol. 67, No. 14, pp. 2493-2497.

J. M. Wells et al., "Charge dependance protonated insulin decompositions", *International Journal of Mass Spectrometry*, 2000, vol. 203, pp. 1-9.

S. A. McLuckey et al., "Charge Determination of Product Ions Formed from Collision-Induced Dissociation of Multiply Protonated Molecules via Ion/Molecule Reactions", *Anal. Chem.*, 1991, vol. 63, No. 18, pp. 1971-1978.

A. P. Hunter et al., "Proton-transfer Reactions of Mass-selected Multiply Charged Ions", *Rapid Communications in Mass Spectrometry*, 1994, vol. 8, pp. 417-422.

S. A. McLuckey et al., "Novel quadrupole ion trap methods for characterizing the chemistry of gaseous macro-ions", *International Journal of Mass Spectrometry*, 2000, vol. 200, pp. 137-161.

J. L. Stephenson, Jr., et al., "Gaseous Protein Cations Are Amphoteric", *J. Am. Chem. Soc.*, 1997, vol. 119, No. 7, pp. 1688-1696.

S. A. McLuckey et al., "Ion/Ion Proton-Transfer Kinetics: Implications for Analysis of Ions Derived from Electrospray of Protein Mixtures", *Anal. Chem.*, 1998, vol. 70, No. 6, pp. 1198-1202.

S. A. McLuckey et al., "Selective Ion Isolation/Rejection Over a Broad Mass Range In the Quadrupole Ion Trap", *J. Am. Soc. Mass Spectrom*, 1991, vol. 2, pp. 11-21.

D. C. Muddiman et al., "Charge-State Reduction with Improved Signal Intensity of Oligonucleotides in Electrospray Ionization Mass Spectrometry", *J. Am. Soc. Mass Spectrom*, 1996, vol. 7, pp. 697-706.

S. A. McLuckey et al., "Reactions of Dimethylamine with Multiply Charged Ions of Cytochrome *c", J. Am. Chem. Soc.*, 1990, vol. 112, No. 14, pp. 5668-5670.

E. R. Williams, "Proton Transfer Reactivity of Large Multiply Charged Ions", *J. . Mass Spectrom*, 1996, vol. 31, pp. 831-842.

M. G. Ikonomou et al., "An Ion source with which ions produced by electrospray can be subjected to ion/molecule reactions at intermediate pressures (10-100 Torr.) Deprotonation of polyprotonated peptides", *International Journal of Mass Spectometry and Ion Processes*, 1992, vol. 117, pp. 283-298.

B. E. Winger et al., "Gas-Phase Proton Transfer Reactions Involving Multiply Charged Cytochrome *c*Ions and Water Under Thermal Conditions", *J. Am. Soc. Mass Spectrom*, 1992, vol. 3, pp. 624-630.

D. S. Gross, et al., "Experimental Measurement of Coulomb Energy and Intrinsic Dielectric Polarizability of a Multiply Protonated Peptide Ion Using Electrospray Ionization Fourier-Transform Mass Spectrometry", *J. Am. Chem. Soc.*, vol. 117, No. 3, pp. 883-890.

C. J. Cassady et al., "Elucidation of Isometric Structures for Ubiquitin $[M + 12H]^{12}+$ Ions Produced by Electrospray Ionization Mass Spectrometry", *J. Mass Spectrom*, 1996, vol. 31, pp. 247-254.

J. L. Stephenson, Jr. et al., "Ion/Ion Reactions in the Gas Phase: Proton Transfer Reactions Involving Multiply-Charged Proteins", *J. Am. Chem. Soc.*, 1996, vol. 118, No. 31, pp. 7390-7397.

R. R. O. Loo et al., "Evidence of Charge Inversion in the Reaction of Singly Charged Anions with Multiply Charged Macrolons", *J. Phys. Chem.*, 1991, vol. 95, No. 17, pp. 6412-6415.

M. Scalf et al., "Controlling Charge States of Large Ions", *Science*, vol. 283, pp. 194-197.

M. Scalf et al., "Charge Reduction Electrospray Mass Spectrometry", *Anal. Chem.*, 2000, vol. 72, No. 1, pp. 52-60.

W. J. Herron et al., "Ion-Ion Reactions in the Gas Phase: Proton Transfer Reactions of Protonated Pyridine with Multiply Charged Oligonucleotide Anions", *J. Am. Soc. Mass Spectrom*, 1995, vol. 6, pp. 529-532.

W. J. Herron et al., "Gas-Phase Electron Transfer Reactions from Multiply-Charged Anions to Rare Gas Cations", *J. Am. Chem. Soc.*, 1995, vol. 117, No. 46, pp. 11555-11562.

A. H. Payne et al., "Gas-phase ion/ion interactions between peptides or proteins and iron ions in a quadrupole ion trap", *international Journal of Mass Spectrometry*, 2001, vol. 204, pp. 47-54.

J. N. Louris et al., "Instrumentation, Applications, and Energy Deposition in Quadrupole Ion-Trap Tandem Mass Spectrometry", *Anal. Chem.*, 1997, vol. 59, No. 13, pp. 1677-1685.

J. D. Williams et al., "Resonance Ejection Ion Trap Mass Spectrometry and Nonlinear Field Contributions: The Effect of Scan Direction on Mass Resolution", *Anal. Chem.*, 1994, vol. 66, No. 5, pp. 725-729.

W. J. Herron et al., "Product Ion Charge State Determination via Ion/Ion Proton Transfer Reactions", *Anal. Chem.*, 1996, vol. 68, pp. 257-262.

J. L. Stephenson, Jr. et al., "Simplification of Product Ion Spectra Derived from Multiply Charged Parent Ions via Ion/Ion Chemistry", *Anal. Chem.*, 1998, vol. 70, No. 17, pp. 3533-3544.

S. A. McLuckey et al., "Ion/Ion Chemistry of High-Mass Multiply Charged Ions", *Mass Spectrometry Reviews*, 1998, pp. 369-407.

G. E. Reid et al., "Charge-State-Dependent Sequence Analysis of Protonated Ubiquitin Ions via Ion Trap Tandem Mass Spectrometry", *Anal. Chem.*, 2001, vol. 73, pp. 3274-3281.

R. E. March, "An Introduction to Quadrupole Ion Trap Mass Spectrometry", *Journal of Mass Spectromery*, 1997, vol. 32, pp. 351-369.

J. L. Stephenson, Jr. et al., Adaptation of the Paul Trap for study of the reaction of multiply charged cations with singly charged anions, *Int. J. Mass Spectrom. Ion Processes*, 1997, vol. 162, pp. 89-106.

J.M. Campbell; B.A. Collings; D.J. Douglas; "A New Linear Ion Trap Time-of-flight System with Tandem Mass Spectrometry Capabilities,", *Rapid Commun. Mass Spectrom.*, 1998, vol. 12, pp. 1463-1474.

B. A Collings; J.M. Campbell; Dummin Mao; D. J. Douglas; "A combined linear ion trap time-of flight system with improved performance and $MS^n$ capabilities," *Rapid Commun. Mass Spectrom.*, 2001, vol. 15, pp. 1777-1795.

Alan G. Marshall; Christopher L. Hendrickson; George S. Jackson; "Fourier Transform Ion Cyclotron Resonance Mass Spectrometry: A Primer," *Mass Spectrometry Reviews*, 1998, vol. 17, pp. 1-35.

James L. Stephenson, Jr.; Scott A. McLuckey; "Anion Effects on Storage and Resonance Ejection of High Mass-to-Charge Cations in Quadrupole Ion Trap Mass Spectrometry," *Anal. Chem.*, 1997, vol. 69, pp. 3760-3766.

{0=1(+6)}/{1(+u)}

METHOD OF SELECTIVELY INHIBITING REACTION BETWEEN IONS

CROSS-REFERENCE TO RELATED APPLICATIONS

This application is a divisional of U.S. application Ser. No. 10/485,807 filed Feb. 4, 2004, now U.S. Pat. No. 7,064,317, which is a U.S. national counterpart application of international application Serial No. PCT/US02/25419 filed Aug. 12, 2002, which claims the benefit of U.S. provisional application Ser. No. 60/312,574 filed Aug. 15, 2001.

GOVERNMENT RIGHTS

This invention was made with support of funds provided under Grant No. GM 45372 awarded by the National Institutes of Health. The United States Government has certain rights in the invention.

TECHNICAL FIELD OF THE INVENTION

The present invention relates generally to a method of selectively inhibiting the reaction between certain ions, and more particularly to a method of operating an ion trap which includes selectively inhibiting the reaction between certain ions of opposite polarity.

BACKGROUND OF THE INVENTION

A three-dimensional quadrupole ion trap includes three electrodes which define a chamber. Two of the three electrodes are virtually identical and, while having hyperboloidal geometry, resemble small inverted saucers. The electrodes which resemble inverted saucers are called end-cap electrodes and are typically distinguishable by a number of holes in the center of each electrode. For example, one end-cap electrode may have a single small central aperture through which ions can be gated periodically, and the other end-cap electrode may have several small centrally arranged apertures through which ions can be ejected from the chamber of the ion trap so as to interact with a detector. (Note that ion traps which utilize external ion sources typically have a single perforation in each end-cap electrode.) The third electrode also has hyperboloidal geometry and is called the ring electrode. The ring electrode is positioned symmetrically between the two end-cap electrodes, and all three cooperate to define the aforementioned ion trap chamber.

The geometries of the electrodes are defined so as to produce a quadrupole field which, in turn, will produce an ion trapping potential for the confinement of ions in an area within the chamber of the ion trap defined by the ion trapping potential. For example, an ion trapping potential can be created from a field generated when an oscillating potential is applied to the ring electrode and the two end-cap electrodes are grounded.

Because a quadrupole ion trap can generate an ion trapping potential for the confinement of ions, it can function as an ion storage device in which gaseous ions can be confined for a period of time in the presence of a buffer gas, such as 1 mTorr of helium gas. For example, as a storage device, the ion trap can act as an "electric field test-tube" for the confinement of gaseous ions, either positively or negatively charged, or both, in the absence of solvent.

One use of the confinement of gaseous ions in such a "test-tube" permits the study of gas-phase ion chemistry. In addition, the ion trap can also function as a mass spectrometer in that the mass-to-charge ratios of the confined ions can be measured. For example, as each ion species is ejected from the chamber of the ion trap in a mass selected fashion, the ejected ions impinge upon an external detector thereby creating a series of ion signals dispersed in time which constitutes a mass spectrum. Ejection of ions from the chamber of the ion trap can be accomplished by ramping, in a linear fashion, the amplitude of a radio frequency (r.f.) potential applied to the ring electrode; each ion species is ejected from the chamber (and thus the area defined by the ion trapping potential) at a specific r.f. amplitude and, because the initial amplitude and ramping rate are known, the mass-to-charge can be determined for each ion species upon ejection. This method for measuring mass-to-charge ratios of confined ions is known as the "mass-selective axial instability mode".

One area of interest in which the above described ion traps are utilized is the study of large polyatomic molecules such as peptides, proteins, oligonucleotides, carbohydrates, and synthetic polymers. These polyatomic molecules can be studied in ion traps due to ionization methods introduced during the past fifteen years which can produce multiply-charged ions from such large molecules. These methods include electrospray ionization (ESI), massive cluster impact ionization, and matrix-assisted laser desorption ionization (MALDI)). ESI and MALDI in particular have become the ionization methods of choice for most large polyatomic molecules such as those mentioned above. In the case of MALDI, singly charged ions usually dominate the population of ions produced. However, in the case of ESI, multiply charged polyatomic molecules usually dominate the population of ions produced. In addition, the population of multiply charged ions produced with ESI has a distribution, or range, of charge states, all of which are substantially greater than +1 or −1. As such, the population of multiply charged ions produced with ESI has a distribution, or range, of mass-to-charge ratios.

Having a population of polyatomic molecules present in the chamber of the ion trap which represents a range of mass-to-charge ratios can be a drawback. In particular, the charge state of the polyatomic molecule of interest may be spread out over 10-15 different ionic states which results in a plurality of relatively weak signals when the population of multiply charged polyatomic ions is analyzed. For example, each charge state gives rise to one relatively weak mass spectrum signal when the population of polyatomic ions is subjected to the previously mentioned "mass-selective axial instability mode" of mass spectrometry. Accordingly, there is a need for a method of operating an ion trap which addresses the aforementioned drawback.

SUMMARY OF THE INVENTION

In accordance with one embodiment of the present invention, there is provided a method of operating an ion trap. The method includes (a) creating an ion trapping potential within a chamber of the ion trap with an electrode assembly of the ion trap, (b) disposing a population of ions in an area defined by the ion trapping potential, wherein (i) the population of ions includes a first subpopulation of ions and a second subpopulation of ions, (ii) each ion of the first subpopulation of ions carries multiple charges, (iii) each ion of the first subpopulation of ions has a mass-to-charge ratio which is the same or different as other ions of the first subpopulation of ions such that ions of the first subpopulation of ions define a range of mass-to-charge ratios, and (iv) each ion of the second subpopulation of ions carries a charge which is opposite to a charge carried by each ion of the first subpopulation of ions, and (c) exposing the population of ions to a first resonance excitation frequency during a mass-to-charge altering reaction between the first subpopulation of ions and the second subpopulation of ions, the first resonance excitation frequency being tuned so that (i) when an ion of the first subpopulation of ions attains a first predetermined mass-to-charge ratio, the ion having the first predetermined mass-to-charge ratio is selectively inhibited from reacting with ions of the second subpopulation of ions and (ii) ions of the first subpopulation of ions having the first predetermined mass-to-charge ratio are selectively accumulated in the chamber of the ion trap during the exposure of the population of ions to the first resonance excitation frequency.

In accordance with another embodiment of the present invention, there is provided a method of operating an ion trap. The method includes (a) disposing a population of ions in an area defined by an ion trapping potential positioned within a chamber of the ion trap, wherein (i) the population of ions includes a first subpopulation of ions and a second subpopulation of ions, (ii) each ion of the first subpopulation of ions carries multiple charges, (iii) each ion of the first subpopulation of ions has a mass-to-charge ratio which is the same or different as other ions of the first subpopulation of ions such that ions of the first subpopulation of ions define a range of mass-to-charge ratios, and (iv) each ion of the second subpopulation of ions carries a charge which is opposite to a charge carried by each ion of the first subpopulation of ions, (b) applying a voltage to an electrode of the ion trap so as to generate a first excitation resonance frequency, and (c) exposing the population of ions to the first resonance excitation frequency during a mass-to-charge altering reaction between the first subpopulation of ions and the second subpopulation of ions, the first resonance excitation frequency being tuned so that (i) when an ion of the first subpopulation of ions attains a first predetermined mass-to-charge ratio, the ion having the first predetermined mass-to-charge ratio is selectively inhibited from reacting with ions of the second subpopulation of ions and (ii) ions of the first subpopulation of ions having the first predetermined mass-to-charge ratio are selectively accumulated in the chamber of the ion trap during the exposure of the population of ions to the first resonance excitation frequency.

In accordance with still another embodiment of the present invention, there is provided a method of operating an ion trap. The method includes (a) disposing a population of ions in an area defined by an ion trapping potential positioned within a chamber of the ion trap, wherein (i) the population of ions includes a first subpopulation of ions and a second subpopulation of ions, (ii) each ion of the first subpopulation of ions carries multiple charges, (iii) each ion of the first subpopulation of ions has a mass-to-charge ratio which is the same or different as other ions of the first subpopulation of ions such that ions of the first subpopulation of ions define a range of mass-to-charge ratios, and (iv) each ion of the second subpopulation of ions carries a charge which is opposite to a charge carried by each ion of the first subpopulation of ions and (b) exposing the population of ions to a resonance excitation frequency during a mass-to-charge altering reaction between the first subpopulation of ions and the second subpopulation of ions, the resonance excitation frequency being tuned to inhibit the mass-to-charge altering reaction between an ion of the first subpopulation of ions having a predetermined mass-to-charge ratio and an ion of the second subpopulation of ions so that (i) when an ion of the first subpopulation of ions attains the predetermined mass-to-charge ratio, the ion having the predetermined mass-to-charge ratio is selectively inhibited from reacting with ions of the second subpopulation of ions and (ii) ions of the first subpopulation of ions having the predetermined mass-to-charge ratio are selectively accumulated in the chamber of the ion trap during the exposure of the population of ions to the first resonance excitation frequency.

In accordance with yet another embodiment of the present invention, there is provided a method of manipulating ions. The method includes (a) disposing a population of ions in an area defined by an ion trapping potential, wherein (i) the population of ions includes a first subpopulation of ions and a second subpopulation of ions, (ii) each ion of the first subpopulation of ions has a mass-to-charge ratio which is the same or different as other ions of the first subpopulation of ions such that ions of the first subpopulation of ions define a range of mass-to-charge ratios, and (iii) each ion of the second subpopulation of ions carries a charge which is opposite to a charge carried by each ion of the first subpopulation of ions and (b) exposing the population of ions to a resonance excitation frequency during a mass-to-charge altering reaction between the first subpopulation of ions and the second subpopulation of ions, the resonance excitation frequency being tuned to inhibit the mass-to-charge altering reaction between an ion of the first subpopulation of ions having a predetermined mass-to-charge ratio and an ion of the second subpopulation of ions so that (i) when an ion of the first subpopulation of ions attains the predetermined mass-to-charge ratio, the ion having the predetermined mass-to-charge ratio is selectively inhibited from participating in the mass-to-charge altering reaction and (ii) ions of the first subpopulation of ions having the predetermined mass-to-charge ratio are selectively accumulated during the exposure of the population of ions to the resonance excitation frequency.

In accordance with still another embodiment of the present invention, there is provided a method of inhibiting a reaction between ions. The method includes (a) disposing a population of ions in an area defined by an ion trapping potential, wherein (i) the population of ions includes a first subpopulation of ions and a second subpopulation of ions, (ii) each ion of the first subpopulation of ions carries multiple charges, (iii) each ion of the first subpopulation of ions has a mass-to-charge ratio which is the same or different as other ions of the first subpopulation of ions such that ions of the first subpopulation of ions define a range of mass-to-charge ratios, and (iv) each ion of the second subpopulation of ions carries a charge which is opposite to a charge carried by each ion of the first subpopulation of ions and (b) simultaneously exposing the population of ions to a first resonance excitation frequency and a second resonance excitation frequency during a mass-to-charge altering reaction between the first subpopulation of ions and the second subpopulation of ions, the first resonance excitation frequency being tuned so that (i) when an ion of the first subpopulation of ions attains a first predetermined mass-to-charge ratio, the ion having the first predetermined mass-to-charge ratio is selectively inhibited from reacting with ions of the second subpopulation of ions and (ii) ions of the first subpopulation of ions having the first predetermined mass-to-charge ratio are selectively accumulated during the exposure of the population of ions to the first resonance excitation frequency, and the second resonance excitation frequency being tuned so that (i) when an ion of the first subpopulation of ions attains a second predetermined mass-to-charge ratio, the ion having the second predetermined mass-to-charge ratio is selectively inhibited from reacting with ions of the second subpopulation of ions and (ii) ions of the first subpopulation of ions having the second predetermined mass-to-charge ratio are selectively accumulated during the exposure of the population of ions to the second resonance excitation frequency.

In accordance with still another embodiment of the present invention, there is provided a method of manipulating ions. The method includes (a) storing ions having a first polarity in x, y, and z-dimensions of a combined magnetic/electrostatic ion trap, (b) storing ions having a second polarity in x and y-dimensions of the combined magnetic/electrostatic ion trap, (c) initiating a mass-to-charge ratio altering reaction between the ions having the first polarity and the ions having the second polarity by advancing ions having the second polarity in the z-dimension of the combined magnetic/electrostatic ion trap, and (d) exposing the ions having the first polarity and the ions having the second polarity to a resonance excitation frequency during the mass-to-charge altering reaction, the resonance excitation frequency being tuned so that (i) when an ion having the first polarity attains a predetermined mass-to-charge ratio, the ion having the predetermined mass-to-charge ratio is selectively inhibited from participating in the mass-to-charge ratio altering reaction and (ii) the ions having the predetermined mass-to-charge ratio are selectively accumulated during the exposure to the resonance excitation frequency.

In accordance with still another embodiment of the present invention, there is provided a method of manipulating ions. The method includes (a) storing ions having a first polarity in x, y, and z-dimensions of a two-dimensional quadrupole ion trap, (b) storing ions having a second polarity in x and y-dimensions of the two-dimensional quadrupole ion trap, (c) initiating a mass-to-charge ratio altering reaction between the ions having the first polarity and the ions having the second polarity by advancing ions having the second polarity in the z-dimension of the two-dimensional quadrupole ion trap, and (d) exposing the ions having the first polarity and the ions having the second polarity to a resonance excitation frequency during the mass-to-charge altering reaction, the resonance excitation frequency being tuned so that (i) when an ion having the first polarity attains a predetermined mass-to-charge ratio, the ion having the predetermined mass-to-charge ratio is selectively inhibited from participating in the mass-to-charge ratio altering reaction and (ii) the ions having the predetermined mass-to-charge ratio are selectively accumulated during the exposure to the resonance excitation frequency.

It is an object of the present invention to provide a new and useful method of operating an ion trap.

It is another object of the present invention to provide an improved method of operating an ion trap.

It is an object of the present invention to provide a new and useful method of operating a mass spectrometer having an ion trap.

It is still another object of the present invention to provide an improved method of operating a mass spectrometer having an ion trap.

It is yet another object of the present invention to provide a new and useful method of inhibiting a reaction between ions of opposite polarity.

It is still another object of the present invention to provide an improved method of inhibiting a reaction between ions of opposite polarity.

It is a further object of the present invention to provide a method of operating an ion trap or a mass spectrometer having an ion trap which enhances analytically useful capabilities for the analysis of mixtures and for the study of the chemistry of high mass multiply charged ions.

It is still another object of the present invention to provide a method of operating an ion trap or a mass spectrometer having an ion trap which allows for the selective accumulation of particular charge state macro-ions in the case of single analyte molecule and in the case of multiply charged ions derived from simple protein mixture.

The above and other objects, features, and advantages of the present invention will become apparent from the following description and the attached drawings.

DETAILED DESCRIPTION OF A PREFERRED EMBODIMENT

Figure 1A:
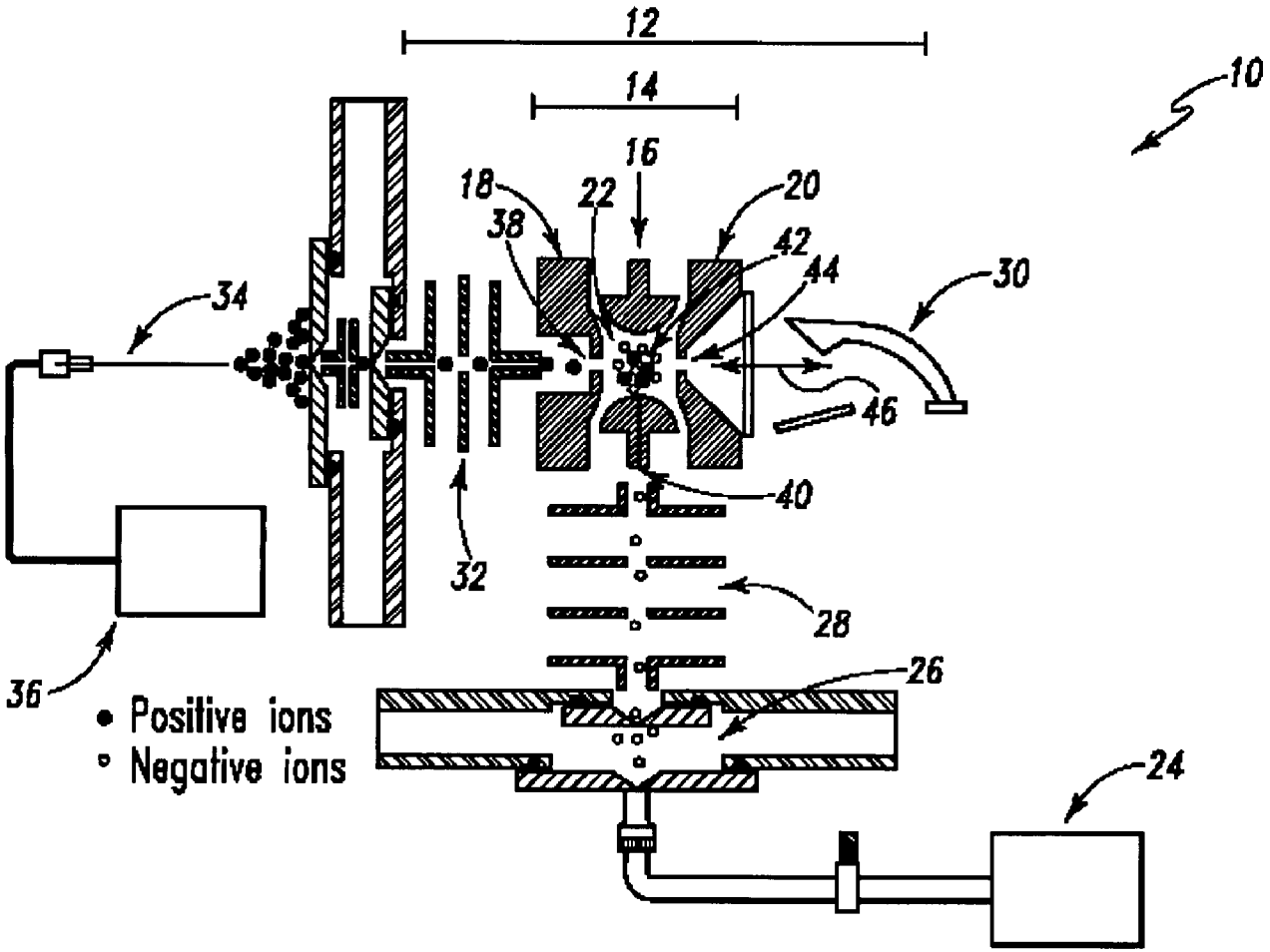
FIG. 1*a*. is a schematic representation of an exemplary ion trapping instrument which can be utilized to perform an embodiment of a method of the present invention.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

As previously discussed, ion traps, such as quadrupole ion traps, and instruments which contain an ion trap, along with the necessary circuitry, power supply components, controller, and software for operating the instrument and/or ion trap are known and commercially available from companies such as Thermo Finnigan, located in San Jose, Calif., Bruker Daltronics, located in Billerica, Mass., and Hitachi, located in Tokyo, Japan. In particular, as discussed in greater detail below, one ion trap which can be adapted to perform an embodiment of a method of the present invention is commercially available from Hitachi as model M-8000. Furthermore, the details of operating an ion trap and instruments which contain an ion trap, including the application of an appropriate voltage to an electrode of the ion trap so as to (i) generate an electric field which serves as the aforementioned ion trapping potential for the confinement of ions or (ii) generate a resonance ejection frequency so that ions are ejected from the chamber of an ion trap (e.g., ramping, in a linear fashion, the amplitude of a radio frequency (r.f.) potential applied to one of the ion trap electrodes) are also known and therefore will not be discussed in detail herein.

However, to facilitate the following discussion a schematic representation of one exemplary ion trapping instrument 10 which can be utilized to perform an embodiment of a method of the present invention is shown in FIG. 1*a*. Ion trapping instrument 10 and its use are described in McLuckey, S. A. Stephenson, Jr., J. L. *Mass Spectrom. Rev.* 1998, 17, 369-407 and Stephenson, Jr., J. L. McLuckey, S. A. *Int. J. Mass Spectrom Ion Processes* 1997, 162, 89-106, both of which, including the references cited therein, are incorporated herein by reference. Therefore, only a brief general overview of ion trapping instrument 10 is set forth below. However, it should be understood that there is no intent to limit the present invention to utilizing the ion trapping instrument 10 shown in FIG. 1*a* (or FIG. 1*b*), and that any appropriate ion trapping instrument or ion trap can be utilized to perform an embodiment of a method of the present invention, including any form of ion trapping device which imposes upon ions mass-to-charge dependent frequencies of motion. Examples of instruments which can be utilized to perform an embodiment of a method of the present invention are described in Campbell, J. M., Collings, B. A. and Douglas, D. J. *Rapid Commun. Mass Spectrom.* 1998, 12, 1463-1474; Collings, B. A., Campbell, J. M., Dunmin, Mao, Douglas, D. J. *Rapid Commun. Mass Spectrom.* 2001, 15, 1777-1795; and Marshall, A. G., Hendrickson, C. L., Jackson, G. S. *Mass Spectrometry Reviews,* 1998, 17, 1-35, all of which are incorporated herein by reference.

One particular example of such a device is the combined magnetic/electrostatic ion trap commonly referred to as an ion cyclotron resonance device. In this device, the magnetic field, which is conventionally defined as being directed along the z-dimension, traps ions in the x- and y-dimensions. Ions assume cyclic motion around the z-axis as determined by the Lorentz equation. Ions are trapped in the z-dimension within the region defined by two trapping plates situated perpendicular to the magnetic field and to which is applied a fixed voltage. In an ion cyclotron resonance device ions of one polarity are stored within a combined magnetic/electrostatic ion trap and ions of opposite polarity are admitted continuously into the ion trapping device along the z-axis. Multiply-charged analyte ions of one polarity are stored in (i) the x-dimension and the y-dimension via a magnetic field that is parallel with the z-axis of the device and (ii) the z-dimension by the two trapping plates situated perpendicular to the magnetic field. Ions of opposite polarity are trapped in the x and y-dimensions via application of a static voltage to aperture plates situated normal to the direction of the magnetic field. The trapping volume is defined by the magnetic field and the spacing between the trapping plates. The ions having the opposite polarity are brought into contact with the stored analyte ions by continuous injection of the opposite polarity ions through an aperture in the center of a plate situated at one end of the trapping volume so as to initiate a mass-to-charge ratio altering reaction between the analyte ions and the oppositely charged ions. Application of a dipolar frequency across opposing plates situated parallel to the direction of the magnetic field of one of the opposing trapping plates that is in resonance with a frequency of motion of an analyte ion having a predetermined mass-to-charge ratio selectively inhibits the rate of reaction of this analyte ion.

Another example of such a device is the two-dimensional quadrupole ion trap where multiply-charged analyte ions of one polarity ions are trapped in the x- and y-dimensions by an oscillating quadrupolar electric field, much the same as with a three-dimensional ion trap. The field can be created within a device of four parallel circular or hyperbolically shaped rods. The structure is comprised of two pairs of opposing rods. To each pair of opposing rods is applied a radio-frequency voltage which is 180 degrees out-of-phase with the other pair of rods. Analyte ions within the device execute mass-to-charge dependent frequencies of motion in like fashion to those in a three-dimensional ion trap. Trapping plates situated on either side of the quadrupole rod assembly are also used to trap the analyte ions in the z-dimension via application of a fixed voltage. In a two-dimensional quadrupole ion trap, ions having a polarity opposite to the analyte ions are stored in x and y-dimensions thereof. The ions having the opposite polarity are admitted continuously into the ion trapping device along the z-axis via an aperture in the center of a plate situated at one end of the quadrupole rods so as to initiate a mass-to-charge ratio altering reaction between the analyte ions and the oppositely charged ions. Application of a dipolar frequency across one of the opposing rod pairs that is in resonance with a frequency of motion of an analyte ion having a predetermined mass-to-charge ratio selectively inhibits the rate of reaction of this analyte ion. (Note that in both the ion cyclrotron resonance and two-dimensional ion trap cases, apertures in the centers of trapping plates allow ions to be injected or ejected from the ion trap.)

Now turning to FIG. 1*a*, ion trapping instrument 10 includes a quadrupole ion trap 12 having an electrode assembly 14. Electrode assembly 14 includes a ring electrode 16, an end-cap electrode 18, and an end-cap electrode 20. Ring electrode 16 is positioned symmetrically between end-cap electrode 18 and end-cap electrode 20. Note that ring electrode 16, end-cap electrode 18, and end-cap electrode 20 cooperate to define a chamber 22 of ion trap 12. Also note that only one half of ring electrode 16, end-cap electrode 18, and end-cap electrode 20 are shown in FIG. 1*a* so that chamber 22 is visible. Ion trapping instrument 10 also includes an electrospray needle 34, a sample introduction device 36 in fluid communication with electrospray needle 34, and a gate lens assembly 32 interposed between electrospray needle 34 and electrode assembly 14. Ion trapping instrument 10 further includes a sample containment vessel 24 in fluid communication with an atmospheric sampling glow discharge ionization source 26, with a lens assembly 28 being interposed between atmospheric sampling glow discharge ionization source 26 and electrode assembly 14.

During use of ion trapping instrument 10, molecules of interest are introduced from sample introduction device 36 and advanced to electrospray needle 34. Electrospray needle 34 then generates multiply charged positive or multiply charged negative ions (indicated by the symbol (○)) from the molecules introduced from sample introduction device 36. The multiply charged ions are advanced through gate lens 32 in the direction of electrode assembly 14 where they enter chamber 22 of ion trap 12 via an aperture 38 defined in the center of end-cap electrode 18. In addition, singly charged ions (indicated by the symbol (○)) formed by atmospheric sampling glow discharge ionization source 26, such as the negatively charged $[M\text{-}F]^-$ and $[M\text{-}CF_3]^-$ ions of perfluoro-1,3-dimethylcyclohexane (PDCH), are introduced from sample containment vessel 24 and advanced through lens 28 in the direction of electrode assembly 14 where they enter chamber 22 of ion trap 12 via an aperture 40 defined in ring electrode 16. As discussed above, an ion trapping potential is created in a known manner within chamber 22 by an electrodynamic field generated by, for example, a radio frequency (r.f.) potential applied to ring electrode 16 while having end-cap electrodes 18 and 20 grounded. As previously mentioned, creating the aforementioned ion trapping potential within chamber 22 allows the confinement of a population of ions which can include, but is not limited to, a subpopulation of multiply charged positive ions and a subpopulation of singly charged negative ions in a buffer gas, such as 1 mTorr of helium gas, in an area 42 defined by the ion trapping potential. (Note that other ion population configurations are contemplated, including for example, but not limited to, a subpopulation of multiply charged negative ions and a subpopulation of singly charged positive ions, or a subpopulation of multiply charged ions of one polarity having a range of masses and a subpopulation of multiply charged ions of an opposite charge; Accordingly, it should be understood that any ion population which can be successfully subjected to the below discussed ion parking of the present invention is contemplated.) Having the subpopulation of multiply charged analyte ions and the subpopulation of singly charged ions of opposite polarity confined in area 42 defined by the ion trapping potential permits the study of gas-phase ion chemistry, including mass-to-charge ratio altering reactions between positively and negatively charged ions. For example, disposing a subpopulation of multiply charged positive ions in chamber 22 along with a subpopulation of singly charged negative ions can result in some, or all, of the positive charges carried by the multiply charged positive ions being neutralized by the negative charges carried by the singly charged negative ions. For example, a positive ion initially carrying a +10 charge at the beginning of the ion/ion (i.e., cation/anion) reaction period can have some of its positive charges neutralized so that at the end of the reaction period the positive ion carries from +9 to 0 charges.

In addition, as previously discussed, ions can be ejected or removed from chamber 22 of ion trap 12 via apertures 38 and 44 defined in end-cap electrodes 18 and 20 by generating a resonance ejection frequency. Generating a resonance ejection frequency results in ions being advanced or accelerated in the general directions indicated by arrow 46 such that ions that exit chamber 22 via aperture 44 interact with detector 30 so as to create signals which can be utilized to create, for example, a mass spectrum.

Note that the control circuitry for ion trapping instrument 10 is described in Stephenson, Jr., J. L. McLuckey, S. A. *Int. J. Mass Spectrom Ion Processes* 1997, 162, 89-106, which is incorporated herein by reference. In addition, one software package for controlling the necessary components of ion trapping instrument 10 is ICMS Software version 2.20, 1992, by N. A. Yates, University of Florida.

Figure 1B:
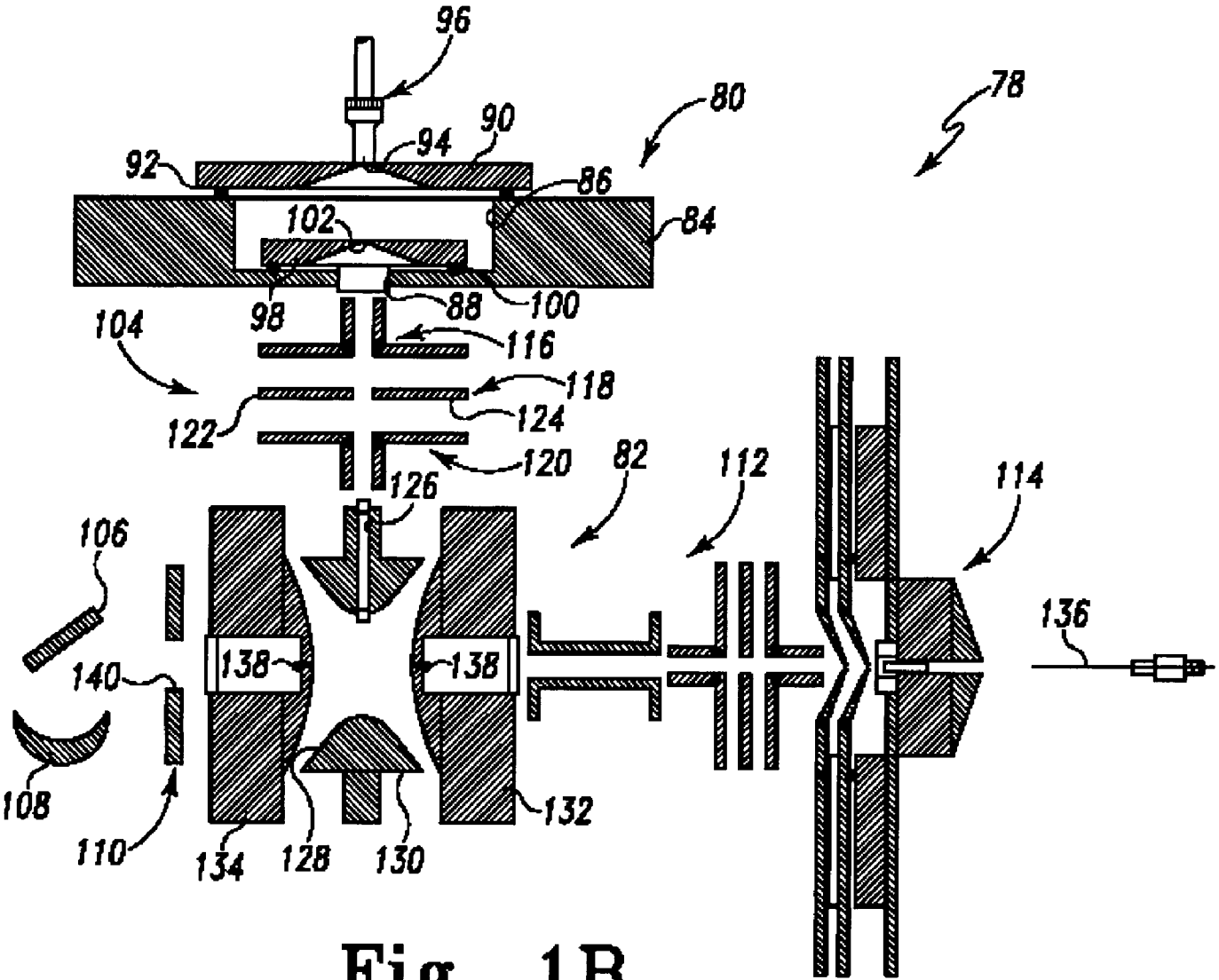
FIG. 1*b* is a schematic representation of another exemplary ion trapping instrument which can be utilized to perform an embodiment of a method of the present invention.

As previously mentioned, the Hitachi model M-8000 ion trap mass spectrometer is adaptable to perform a method of the present invention. In particular, FIG. 1*b* shows a schematic representation (not to scale) of a portion of a Hitachi model M-8000 ion trap mass spectrometer 78 (San Jose, Calif.) adapted to perform a method of the present invention. Spectrometer 78 is substantially similar to, and operates in a substantially similar manner as, ion trapping instrument 10 discussed above in reference to FIG. 1*a*. Briefly, spectrometer 78 includes an atmospheric sampling glow discharge ionization source 80 (ASGDI source) and an ASGDI ion transport lens arrangement 104. ASGDI ion transport lens arrangement 104 includes a series of three DC lenses, i.e., lens 116, lens 118, and lens 120. Also note that lens 118 is divided into two half plates 122 and 124. Spectrometer 78 also includes an ion trap 82, a conversion dynode 106, an electron multiplier 108, a guard ring 110, an electrospray ionization ion transport lens arrangement 112, a skimmer cone 114, and an ESI emitter 134.

In a manner substantially identical to ion trap 12 discussed above, ion trap 82 also includes a ring electrode 130, an end-cap electrode 132, and an end-cap electrode 134. Ring electrode 130 is positioned symmetrically between end-cap electrode 132 and end-cap electrode 134.

ASGDI source 80 includes a 4.5×3.5 inch (11.43×8.89 cm) stainless steel block 84 having (i) a 2-inch (5.08 cm) diameter by 0.75 inch (1.91 cm) deep cavity 86 defined therein and (ii) a 0.5 inch (1.27 cm) through hole 88 defined in a side wall thereof which is in fluid communication with the main vacuum chamber (not shown) of spectrometer 78. Note that cavity 86 acts as an intermediate pressure region. ASGDI source 80 also includes a 3 inch (7.62 cm) diameter× 0.25 inch (0.64 cm) plate 90 mounted onto steel block 84 with an O-ring 92 such that plate 90 is in sealing engagement with steel block 84. Plate 90 has a 250 μm aperture 94 defined therein which separates the source region from atmosphere. ASGDI source 80 further includes a 0.25 inch (0.64 cm) cajon tube fitting 96 welded onto plate 90 such that cajon tube fitting 96 is in fluid communication with aperture 94, and thus allows the introduction of PDCH reagent vapor into cavity 86. ASGDI source 80 also includes 1.625 inch (4.13 cm) diameter×0.1875 inch (0.48 cm) plate 98 positioned within cavity 86. In particular, plate 98 is mounted onto steel block 84 with an O-ring 100 such that plate 98 is in sealing engagement with steel block 84. Plate 98 also has a 250 μm aperture 102 defined therein which is in fluid communication with hole 88 and serves to separate the source region from the main vacuum chamber (not shown) of the spectrometer 78.

ASGDI source 80 is mounted over a 3.75×2.625 inch (9.53×6.67 cm) hole (not shown) cut into a top wall of the vacuum manifold (not shown) of spectrometer 78. In particular, ASGDI source 80 and the top wall of the vacuum manifold are placed in sealing engagement with an o-ring (#244) positioned within a $\frac{1}{8}^{th}$ inch (0.32 cm) deep groove defined in the top wall of the vacuum manifold. In addition, ASGDI source 80 is centered over ion trap 82 of spectrometer 78, as shown in FIG. 1*b*, such that lens arrangement 104 is interposed between ASGDI source 80 and ion trap 82.

A 0.5 inch (1.27 cm) wide and 0.375 inch (0.95 cm) deep notch (not shown) is cut into an outer edge of ring electrode 130. In addition, a 0.0625 inch (0.16 cm) diameter hole 126 is drilled in ring electrode 130 so as to allow the introduction of ASGDI ions into chamber 128 of ion trap 82. Furthermore, endcap electrodes 132 and 134 are modified by replacing the standard endcap aperture inserts with inserts shaped to correspond to the measured endcap hyperbole. Each curved insert has a central hole 138 (see FIG. 1*b*) which has a 0.04 inch (0.10 cm) diameter. In addition, each central hole 138 is surrounded by eight additional outer holes each having a 0.0225 inch (0.06 cm) diameter (not shown). The outer holes are spaced relative to each central hole 138 on a 0.0825 bolt circle. In addition, a 1.5 inch (3.81 cm) diameter×0.75 inch (1.91 cm) guard ring electrode 110 with a 0.25 inch (0.64 cm) diameter through hole 140 is positioned between exit endcap electrode 134 and conversion dynode 106 to enhance sensitivity. A Tennelec model TC950A 5 kV high voltage power supply is used to supply −1.5 kV to guard ring electrode 110.

ASGDI source 80 is operatively coupled to a Leybold D25B rotary vane pump (not shown) (Leybold Vacuum Products, Export, Pa.) via two 0.5 inch (1.27 cm) stainless steel tubes (not shown) placed in fluid communication with cavity 86. Note that a third 0.5 inch (1.27 cm) tube is utilized to operatively couple cavity 86 to a convection gauge for monitoring the pressure within cavity 86. Furthermore, plate 90 and lens arrangement 104 are respectively operatively coupled to an ORTEC model 556 3 kV power supply and an ORTEC model 710 1 kV quad bias power supply, respectively.

It should be appreciated that a characteristic of ion traps, such as ion traps 12 and 82 described above, is that ions contained therein, e.g., in chamber 22 of instrument 10, execute mass-to-charge dependent frequencies of motion when exposed to certain electrodynamic fields generated, for example, by the application of an r.f. potential to the electrodes of the ion trap. As disclosed herein, it has been discovered that this characteristic can be exploited to affect, e.g., inhibit, the rates of ion/ion reactions of ions in a quadrupole ion trap in a mass-to-charge selective fashion so as to selectively accumulate ions having a predetermined mass-to-charge ratio, e.g., within a chamber such as chamber 22, of the ion trap. The aforementioned inhibition of ion/ion reactions for selected ions so as to accumulate the selected ions is denoted herein as "ion parking". In one embodiment, ion parking of the present invention is achieved by the application of a supplementary sine wave frequency to end cap electrodes such that a resonance excitation frequency is generated which is tuned so that the exposure of ions of particular mass-to-charge ratios to the resonance excitation frequency results in these ions being inhibited from participating in further mass-to-charge altering reactions thereby resulting in these ions being selectively and preferentially accumulated, for example, in a chamber of an ion trap. As described herein, ion parking enables several analytically useful capabilities for the analysis of mixtures and for the study of the chemistry of high mass multiply-charged ions.

As mentioned above, ion parking involves inhibiting the rate of ion/ion proton transfer reactions in a selective fashion such that particular ions are preferentially retained or accumulated in the chamber of the ion trap, while ions that are not selected undergo neutralization reactions unperturbed. Several characteristics of ion/ion reactions and ion motion in an ion trap play roles in determining how to effect ion parking and the predetermined mass-to-charge specificity with which ion/ion reactions can be inhibited. These characteristics are described below with particular emphasis on their relationships to ion parking.

Ion/ion reactions in quadrupole ion traps take place in the presence of a light bath gas, predominantly helium, at a pressure of roughly 1 mTorr. Ion/ion proton transfer kinetics operated under these conditions are related to the square of the charges of the reactant ions (Stephenson, J. L., Jr.; McLuckey, S. A. J. Am. Chem. Soc. 1996, 118, 7390-7397 incorporated herein by reference), (McLuckey, S. A.; Stephenson, Jr., J. L.; Asano, K. G. Anal. Chem. 1998, 70, 1198-1202 incorporated herein by reference). The magnitude of the observed ion/ion reaction rates are consistent with the rate determining step being the formation of a stable ion/ion orbiting complex (i.e., consistent with three-body reaction rates at the high pressure limit). The ion/ion capture cross-section is given by the following equation:

$$\sigma_c=\pi[z_1z_2e^2/(\mu v^2)]^2 \quad (1)$$

Where v is the relative velocity of the oppositely-charged ions, μ is the reduced mass of the collision partners, $Z_1$ and $Z_2$ are the number of units of charge on the positive and negative ions, respectively, and e is the charge on an electron. It should be noted that, given the difficulty in determining the number densities of both the anions and cations, it has not been explicitly established that the formation of a stable ion/ion orbiting complex is rate determining under the ion trap operating conditions. However, the charge-squared rate dependence has been consistently observed and this implies that the highest macro-ion charge states react at far higher rates than the low charge states (e.g., a +10 ion reacts 100 times faster than a +1 ion) and the relative difference between reaction rates for ions of adjacent charge states increases as charge state decreases (e.g., a +10 ion reacts 1.23 times faster than a +9 ion whereas a +2 ion reacts four times faster that a +1 ion). Note also that equation 1 indicates that the cross-section for ion/ion capture is inversely related to the fourth power of the relative velocity.

Figure 2:
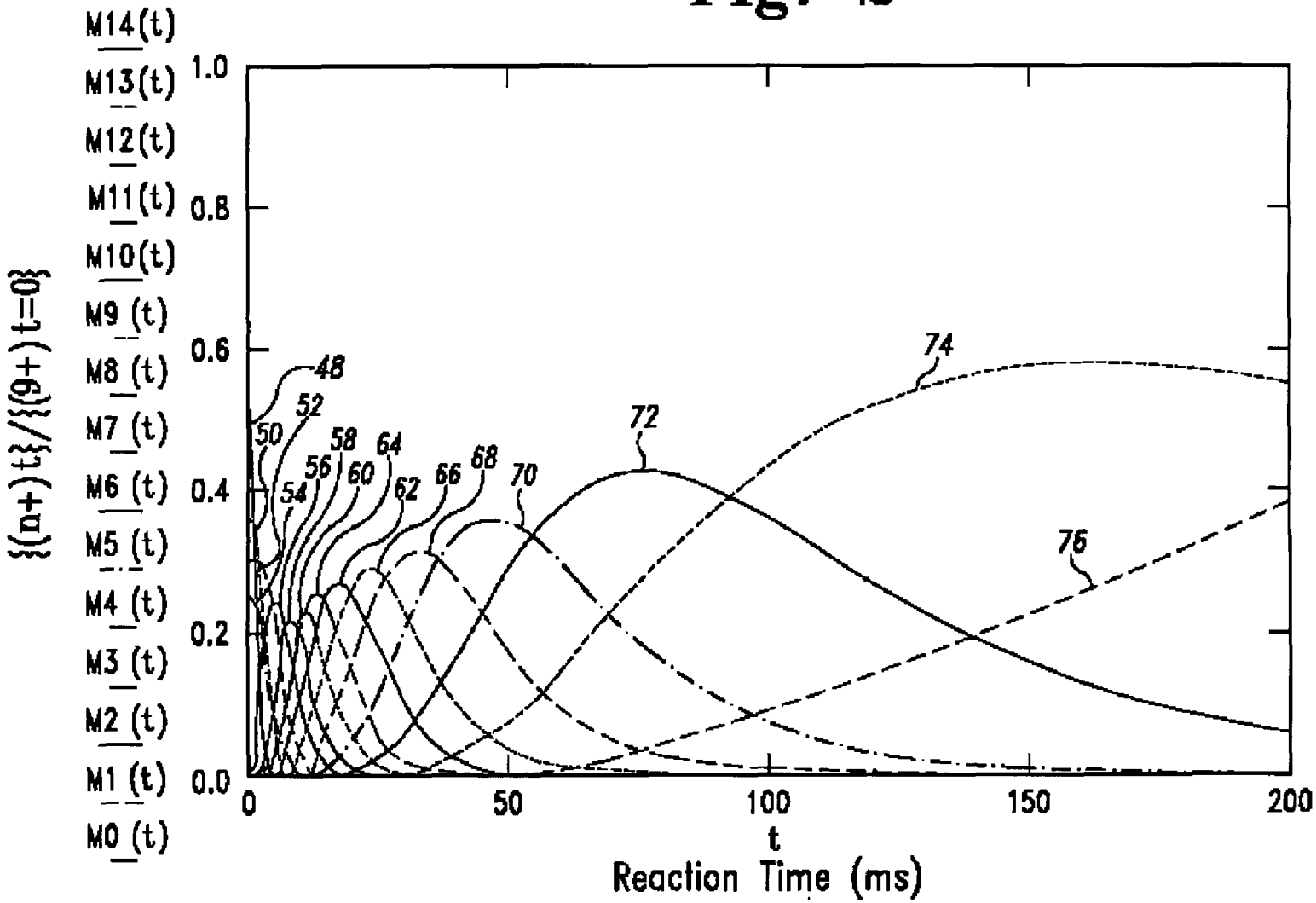
FIG. 2 is a plot of predicted time evolution of positive ion abundances resulting from a reaction of a +14 charge state of cytochrome c with an excess of singly-charged negative ions which reflects a series of consecutive irreversible reactions in which the +1/−1 reaction rate is 5 $s^{-1}$ and all other reaction rates scale as the square of the charges of the ionic reactants.

Several implications for the use of ion/ion reactions to manipulate charge states can be illustrated with the simulated ion abundance versus time plots of FIG. 2. FIG. 2 illustrates the expected evolution of positive ion charge state abundance with mutual ion/ion storage time beginning with a selected ion of charge +14 reacting with singly charged anions present at a constant number density of $6.5\times10^7$ anions-$cm^{-3}$ and a rate constant for the +1/−1 reaction of $8.2\times10^{-8}$ $cm^3$-$ions^{-1}$-$s^{-1}$. (Note that each curve in FIG. 2 represents an ion having a particular charge state, i.e., curve 48 an ion carrying a charge of +14, curve 50 an ion carrying a charge of +13, curve 42 an ion carrying a charge of +12, curve 54 an ion carrying a charge of +11, curve 56 an ion carrying a charge of +10, curve 58 an ion carrying a charge of +9, curve 60 an ion carrying a charge of +8, curve 62 an ion carrying a charge of +7, curve 64 an ion carrying a charge of +6, curve 66 an ion carrying a charge of +5, curve 68 an ion carrying a charge of +4, curve 70 an ion carrying a charge of +3, curve 72 an ion carrying a charge of +2, curve 74 an ion carrying a charge of +1, and curve 76 an ion carrying a charge of 0.)

These conditions give a +1/−1 reaction rate of roughly 5 $s^{-1}$, a magnitude well within the range of rates normally observed in examples of singly-protonated proteins reacting with anions derived from perflurocarbons. FIG. 2 illustrates how rapidly the relatively high charge states change in abundance as a function of reaction time and how slowly the singly-charged ion abundance changes. For example, the +12 ion, the abundance of which in FIG. 2 reflects both the reactivities of the higher charge state ions for its formation and the reactivity of the +12 ion for its disappearance, goes from zero abundance to its maximum abundance and to zero abundance again within roughly 20 ms of reaction time. The +1 ion, on the other hand, begins to appear as early as 50 ms after initiation of the reaction and shows significant abundance for several hundred milliseconds beyond the 200 ms time period displayed in FIG. 2 (data not shown). (This simulation applies to a commonly used experimental scenario in which an excess of negative ion charge, relative to the total positive ion charge, is admitted into the ion trap. The differences in the time evolution of the abundance of the various charge states is even more extreme in the case where roughly equal numbers of positive and negative charges are present. In this case, much of the charge is consumed by the highest charge states such that the number density of the oppositely charged ion decreases significantly with time.)

FIG. 2 illustrates that at any arbitrary reaction time, a range of product ion charge states is observed, with the exception of the trivial case in which all of the ions are neutralized. For example, at the time at which the doubly-charged ions are most abundant, roughly equal abundances of singly- and triply-charged products are observed each of which exceeds 20% of the total product ion abundance. Significant numbers of neutralized species and quadruply-charged species also contribute such that the relative abundance of the doubly-charged ion is less than 0.5. In fact, the plot of FIG. 2 shows that none of the product ions ever exceeds about 60% of the initial reactant ion abundance, and most never exceed 40% of the initial abundance. Accordingly, it should be understood that one advantage of ion parking of the present invention is that it accumulates a single charge state ion within the chamber of the ion trap at the expense of other charge states and, in doing so, can approach 100% of the initial multiply-charged reactant abundance. Furthermore, given the combined variability in the numbers of positive and negative ions admitted into the ion trap for subsequent ion/ion reactions, the product ion charge state distribution can vary significantly from one scan to the next, particularly for the higher charge state product ions. This is not a particularly troublesome issue when the goal is to reduce virtually all ions to singly-charged ions, where ion/ion reaction rates are already relatively low (see FIG. 2). However, when the goal is to form ions of an intermediate charge state for further study, scan-to-scan variability can be problematic. However, since ion parking of the present invention accumulates a single charge state ion within the chamber of the ion trap at the expense of other charge states, it can help decrease the problem of scan-to-scan variability.

Another implication of FIG. 2 for ion parking is that for a constant diminution in ion/ion reaction rate for a selected charge state during a given ion/ion reaction period, the higher charge state ions have a much greater probability for further reaction than the low charge states. For example, for a 95% decrease in ion/ion reaction rate, the +1 charge state ion of the FIG. 2 simulation would decrease in rate from about 5 $s^{-1}$ to 0.25 $s^{-1}$. Very little +1 would react at this rate over the course of a few hundred milliseconds and effective parking of the +1 ion would result. The +12 ion, on the other hand, would go from a reaction rate of about 720 $s^{-1}$ to a rate of 36 $s^{-1}$, which would lead to a significant degree of reaction to lower charge states under the condition of the these simulations even with ion parking. The normal practical time frame for most ion/ion reaction periods is 10-300 ms. To minimize the extent of further reactions for a given diminution in reaction rate and for a given reaction period, it therefore is desirable to reduce the reaction rates of highly charged ions by reducing the number of the oppositely charged reactants. As discussed further below, it is also desirable to use relativity low number densities of reactant ions to minimize space charge.

Ion parking or the selective inhibition of ion/ion reactions of the present invention relies on the exploitation of a unique characteristic of an ion that can be used to affect ion/ion reaction rates. Ion trapping instruments provide such a characteristic in that ions of each mass-to-charge ratio execute a unique set of motions at a number of characteristic frequencies (March, R. E. J. Mass Spectrom. 1997, 32, 351-369, incorporated herein by reference ), (March, R. E.; Hughes, R. J. "Quadrupole Storage Mass Spectrometry", John Wiley & Sons, New York, 1989, incorporated herein by reference), (March, R. E.; Londry, F. A. In "Practical Aspects of Ion Trap Mass Spectrometry, Vol. I: Fundamentals of Ion Trap Mass Spectrometry", R. E. March and J. F. J. Todd (Eds.), CRC Press, Chapter 2, 1995, 25-48, incorporated herein by reference). The mass-to-charge dependent frequencies of motion of ions in a pure oscillating quadrupolar field are given by:

$$\omega_{n,u}=(2n\pm\beta_u)\Omega/2 \quad (2)$$

where u represents either the r-dimension (i.e., the radial plane of the ion trap) or the z-dimension (i.e., the inter-end-cap dimension), n is an integer, Ω is the frequency of the oscillation of the potential applied to the ion trap to effect ion storage, and $\beta_u$ is given approximately by:

$$\beta_u\cong(a_u+q_u^2/2)^{1/2} \quad (3)$$

The $a_u$ parameter is given by:

$$a_u=C_1zeU/[m(r_o^2+2Z_o^2)\Omega^2] \quad (4)$$

and the $q_u$ parameter is given by:

$$q_u=C_2zeV/[m(r_o^2+2Z_o^2)\Omega^2] \quad (5)$$

where the constants $C_1$ and $C_2$ depend upon the specific operating mode of the ion trap (March, R. E.; Hughes, R. J. "Quadrupole Storage Mass Spectrometry", John Wiley & Sons, New York, 1989, incorporated herein by reference), U is the DC potential between the electrodes (usually=0), V is the amplitude of the radio-frequency potential used to trap the ions, $r_o$ is the inscribed radius of the ring electrode, $2Z_o$ is the closest distance between the end-cap electrodes and m/ze is the mass-to-charge ratio of the ion. The fundamental secular frequencies of motion are defined by the condition of n=0. The application of a single frequency waveform to the end-cap electrodes which matches the Z-dimension secular frequency of ions of a particular mass-to-charge ratio results in the Z-dimension acceleration of the ions. This is commonly done with quadrupole ion traps either to eject ions within the context of the acquisition of a mass spectrum (i.e., resonance ejection), to eject ions for the purpose of isolating ions of interest, or to accelerate the ion so as to induce inelastic collisions with the bath gas leading to dissociation. Note that equations (2)-(5) apply to a pure quadrupolar field, which is impossible to achieve in a real device. Furthermore, all commercially available ion taps, as well ion trap 12, are designed to include higher order multipole fields. The existence of such fields leads to an ion frequency dependence upon ion oscillatory amplitude. This effect has implications for ion trap mass analysis and can play a role in ion parking of the present invention. However, the importance of higher order multipole fields on ion acceleration relative to the effect of the presence of oppositely-charged ion clouds, as discussed below, within the context of an ion parking experiment may be dependent upon the number of ions in the ion trap.

As described herein, the fact that ions execute oscillatory motion with mass-to-charge dependant frequencies of motion allows for ion parking of the present invention. That is, an ion of a selected mass-to-charge ratio can be excited or accelerated at one of its frequencies of motion while ions of opposite polarity are stored at the center of the ion trap. It should be appreciated that the rate of ion/ion reaction for the accelerated ion is diminished relative to its rate in the absence of acceleration. While there is no intent to limit the present invention to a particular mechanism, this decrease in the rate of ion/ion reaction might be due to either an increase in the relative velocity of the collision pair (see equation 1), a decrease in the physical overlap of the positive and negative ions as a result of an increase in the oscillatory amplitude of the accelerated ion, or both. However, it should be appreciated that the presence of oppositely-charged ion populations can have an effect on the ion acceleration behavior via the application of supplementary wave-forms to the end-cap electrodes, as demonstrated in a study of resonance ejection in the presence of oppositely-charged ions (Stephenson, Jr., J. L.; McLuckey, S. A. Anal. Chem. 1997, 69, 3760-3766, incorporated herein by reference ). In particular, it has been shown that with sufficiently large numbers of oppositely-charged ions resonance ejection was ineffective. Using a simple point charge picture for the relatively low mass-to-charge (singly-charged) anions, it was shown that the electric field associated with the presence of the anions could exceed the effective trapping potential experienced by much higher mass-to-charge ratio positive ions resulting from the oscillating quadrupolar field. In this scenario, the positive ions could not be ejected using resonance excitation. The extent to which ion parking of the present invention can be effective, therefore, is dependent upon the electric field strengths associated with the oppositely-charged ion clouds.

Figure 3A:
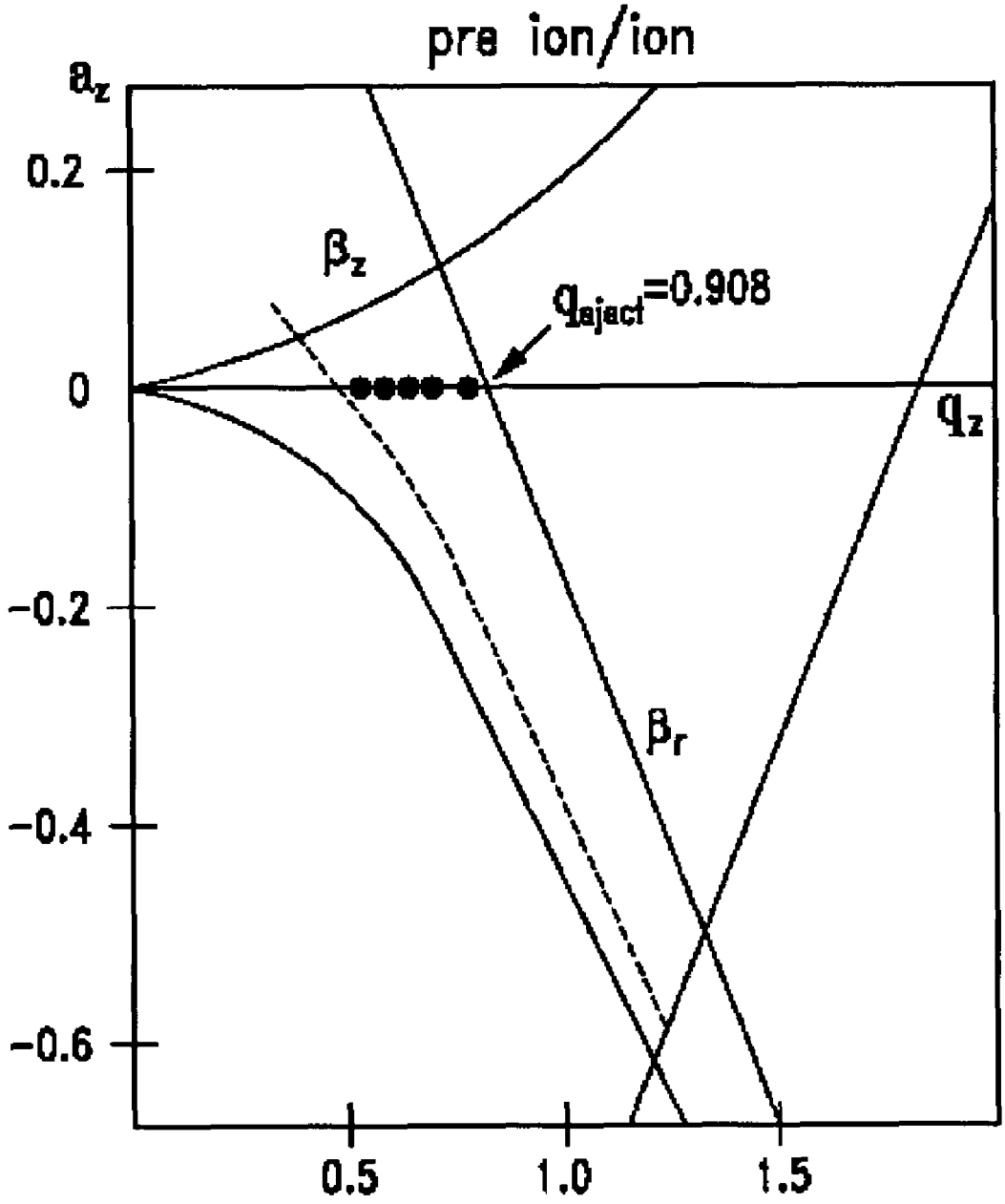
FIG. 3*a* is an ion trap stability diagram which illustrates an initial condition used for ion/ion reactions involving a range of multiply charged ions including a charge state distribution derived from electrospray ionization.
Figure 3B:
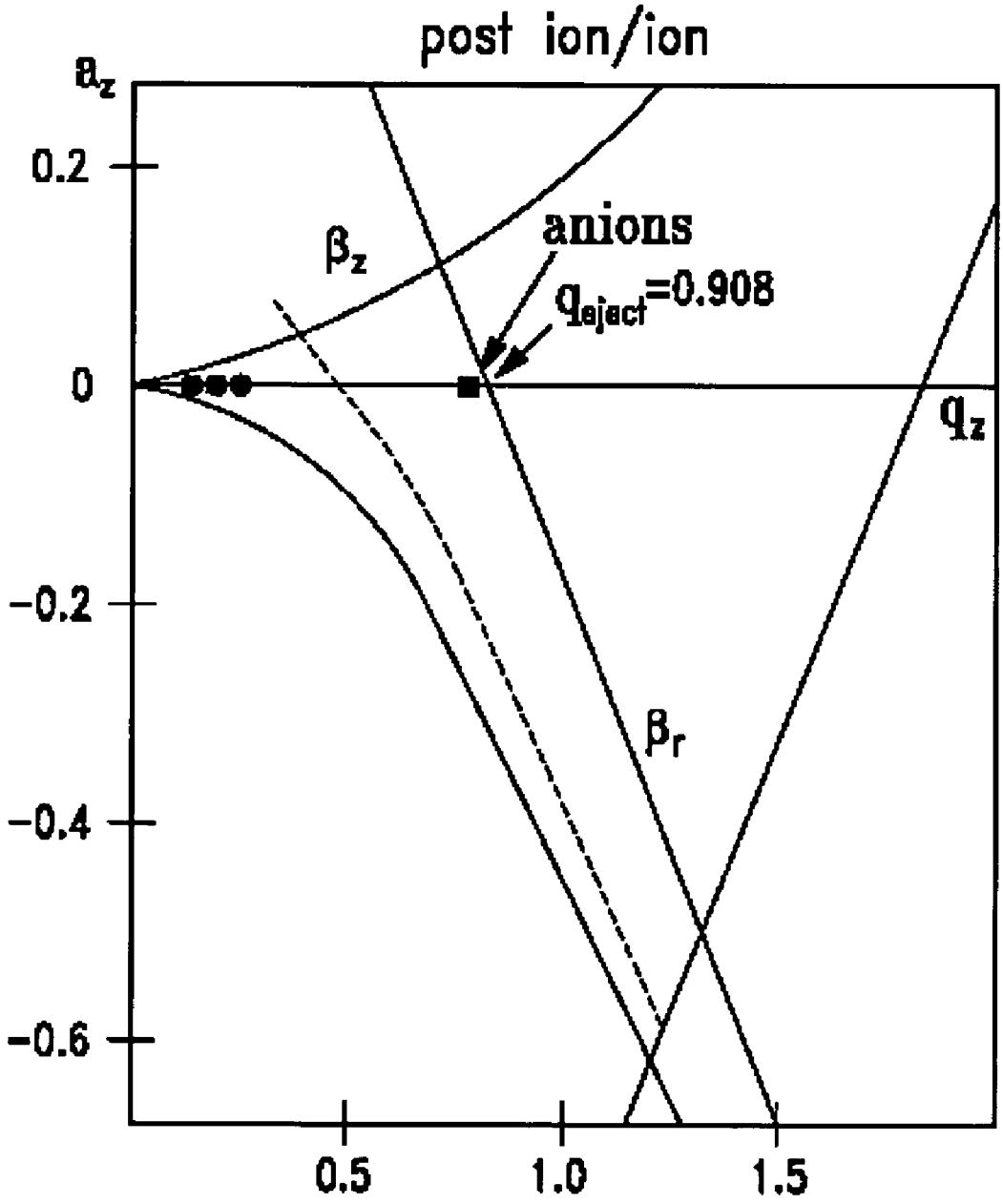
FIG. 3*b* is the ion trap stability diagram of FIG. 3*a* after an ion/ion reaction period in which all of the multiply charged ions have been reduced in charge such that a new lower charge state distribution is formed as represented by the shift in position of the circles (○)
Figure 3C:
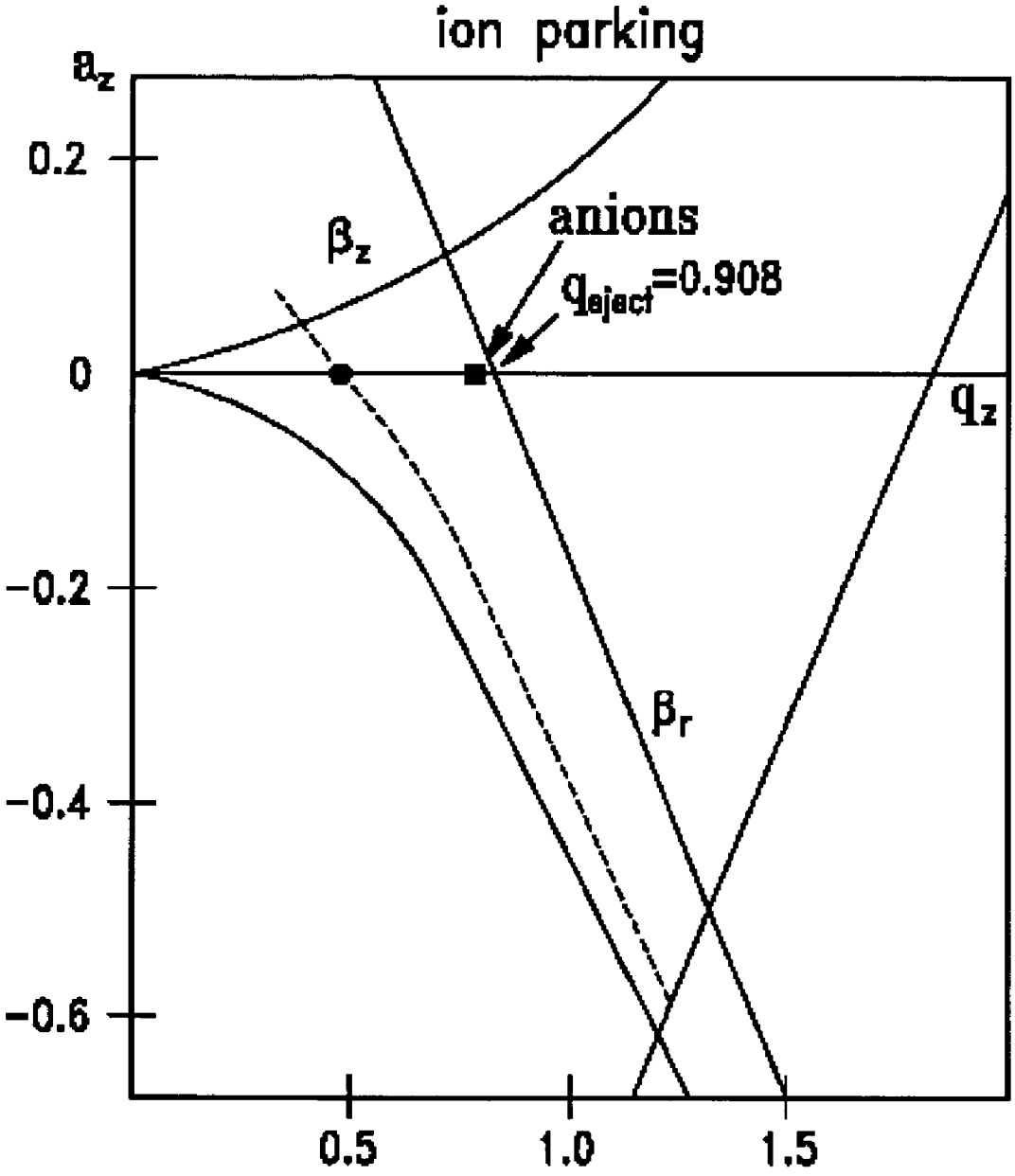
FIG. 3*c* is an ion trap stability diagram which illustrates ion parking of the present invention (note that a resonance excitation voltage of 1.0 $V_{p\text{-}p}$ or greater at the iso-$\beta_z$ line is applied on either one side or the other of the ion of interest)

A number of potentially useful analytical applications are contemplated by utilizing a method of the present invention so as to selectively inhibit ion/ion reaction rates. One example, which was alluded to above, is the ability to stop or slow a reaction at a predetermined selected product ion charge state. This allows essentially all of the initial charge states of the ion above the charge state of interest to be accumulated into a lower charge state of the same species. Such an experiment is illustrated schematically in FIGS. 3*a-c* using a series of ion trap stability diagrams. The stability diagram is a plot of $a_z$ versus $q_z$ which summarizes the locations of the boundaries for stable motion in the r and Z dimensions. Ions are stable (i.e., they execute bounded motions) in the r-plane when the $\beta_r$ values are between zero and one. Likewise, they are stable in the Z-dimension between $\beta_z$ values of zero and one. Ions are stable in both the r-plane and the Z-dimension in the region of overlap between the two. The ion trap is normally operated along the $a_z$=0 line, such that ions of different mass-to-charge ratio fall within the stability diagram along this line with high mass-to-charge ions closest to the origin. FIG. 3*a* illustrates an initial condition used for ion/ion reactions involving a range of multiply-charged ions comprising the charge state distribution derived from electrospray, for example, and which fall in the stability diagram at locations indicated by the circles (○). The dashed line in this figure represents a so-called iso-βz line, which indicates the range of a and q values that yield a constant set of Z-dimension frequencies. The fact that all of the circles (○) lie to the right of the dashed line indicates that all of the ions have Z-dimension secular frequencies greater than that associated with the indicated iso-βz line. A singly charged ion of oppositely polarity formed, for example, by glow discharge ionization, of lower mass-to-charge ratio than any of the multiply-charged ions is indicated in FIG. 3*b* by the square (□). (The mass-to-charge ratio of the oppositely charged ion should not fall on the iso-βz line used for ion parking, as discussed below.) FIG. 3*b* shows the stability diagram after an arbitrary ion/ion reaction period in which all of the multiply-charged ions have been reduced in charge such that a new and much lower charge state distribution is formed, as represented by the shifts in position of the circles (○). The square (□) does not shift, of course, as the singly-charged ions are simply being consumed (neutralized) by the ion/ion reactions. FIG. 3*c* illustrates the principle of ion parking of the present invention. By applying a dipolar sine wave to the end-cap electrodes corresponding to this iso-βz line, any positive ions that fall at or near this point in the stability diagram (provided the electric field of the oppositely-charged ions does not distort the stability diagram such that resonance excitation does not occur) will be accelerated. The ion/ion reaction kinetics of the accelerated ions is significantly reduced relative to that of unaccelerated ions of the same charge, thus product ions of this charge state are accumulated preferentially in the chamber of the ion trap. In this particular example, all of the higher charge state ions can undergo rapid ion/ion reactions until such time as they fall into the region of the stability diagram where they are "parked" by virtue of the reduced ion/ion reaction rates for the accelerated charge state.

The following examples which help illustrate ion parking of the present invention were obtained using bovine cytochrome c and/or horse heart myoglobin. Bovine cytochrome c and horse heart myoglobin were obtained from Sigma (St. Louis, Mo.). Perfluoro-1,3 dimethylcyclohexane (PDCH) was purchased from Aldrich (Milwaukee, Wis.). Solutions for electrospray were prepared by dissolving quantities of either myoglobin or cytochrome c or both to result in concentrations of ~5 μM/protein in methanol/water/acetic acid (50:49:1). Electrospray solutions were delivered to a stainless steel electrospray capillary via a syringe pump with a flow rate of 1 μL/min. Typically, the voltage applied to the capillary needle ranged from +3.0-3.5 kV.

All experiments were performed with an electrospray source coupled to a Finnigan-MAT (San Jose, Calif.) ion trap mass spectrometer as described in McLuckey, S. A.; Stephenson, Jr., J. L.; Asano, K. G. Anal. Chem. 1998, 70, 1198-1202, which is incorporated herein by reference, that was modified for the addition of negatively charged (PDCH) ions through a hole in the ring electrode as described in Stephenson, J. L., Jr.; McLuckey, S. A. Int. J. Mass Spectrom. Ion Processes 1997, 162, 89-106, which is incorporated herein by reference. A typical scan function used in this study featured positive ion accumulation (20-100 ms), anion injection (1-3 ms), mutual cation/anion storage (100-300 ms), and mass analysis using resonance ejection.

The spectra recorded after ion/ion reactions were used to reduce ion charge states are referred to as post-ion/ion mass spectra. Resonance ejection for these post-ion/ion spectra was performed at either 17,000 Hz, and 1.5 $V_{p-p}$ to give an upper mass-to-charge limit of 13,000 or 89,202 Hz and 9.8 $V_{p-p}$ to give an upper mass-to-charge limit of 2,400. Each mass spectrum presented herein is the average of 100-300 scans.

Figure 4A:
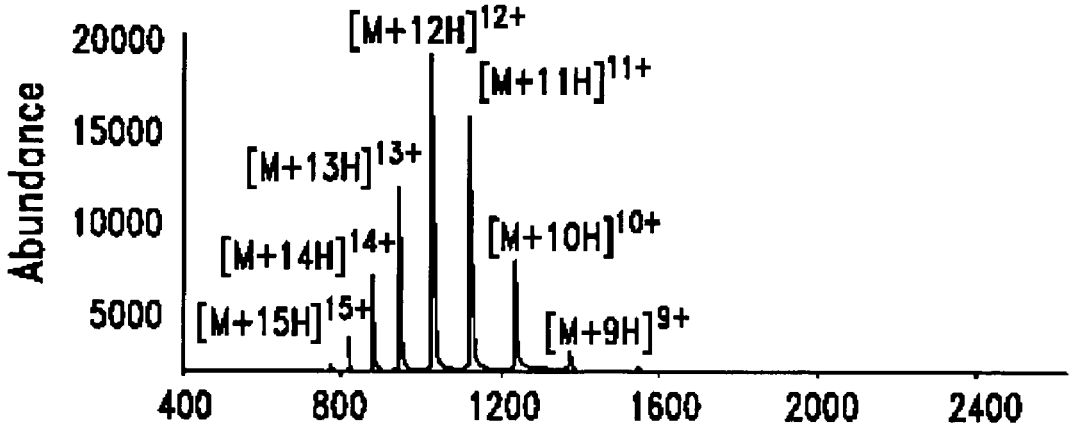
FIG. 4*a* is a mass spectrum of bovine cytochrome c ions acquired in pre ion/ion mode, using a resonance ejection frequency of 89,202 Hz and an amplitude of 9.8 $V_{p\text{-}p}$.
Figure 4B:
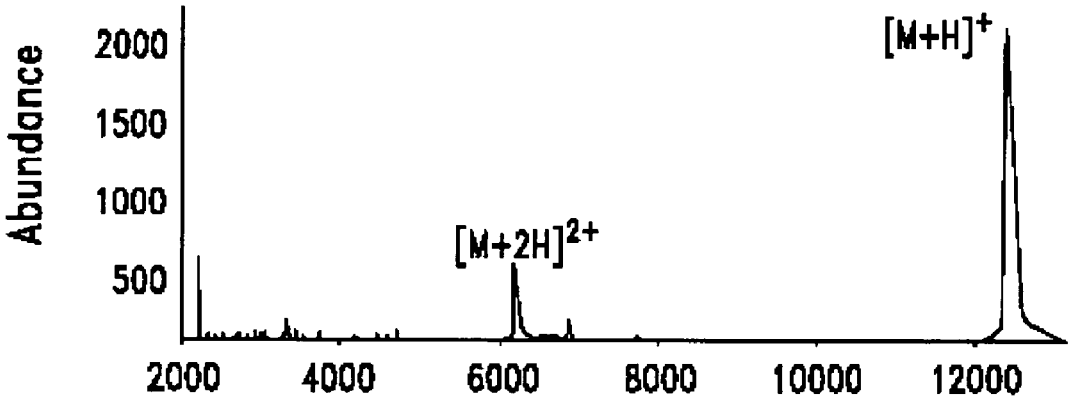
FIG. 4*b* is a mass spectrum of bovine cytochrome c ions acquired post ion/ion mode, using a resonance ejection frequency of 17,000 Hz and an amplitude of 1.5 $V_{p\text{-}p}$ (note that the anions were admitted into the ion trap for 3 ms and a mutual cation/anion storage time of 300 ms was used prior to anion ejection and subsequent mass analysis)
Figure 4C:
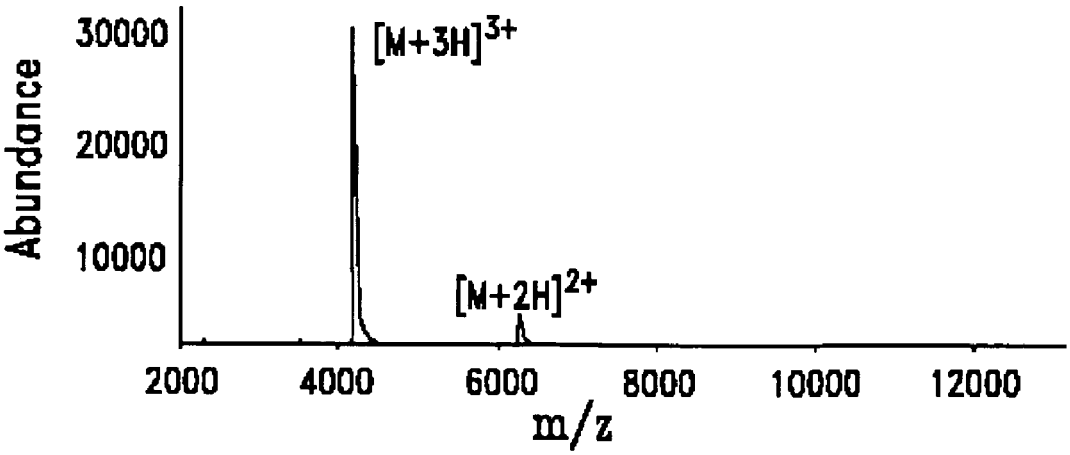
FIG. 4*c* is a mass spectrum of bovine cytochrome c ions acquired in an ion parking mode of the present invention, using the same resonance ejection frequency and ion/ion conditions as described in FIG. 4*b*, but also exposing the population of ions to a resonance excitation frequency of 15,000 Hz and an amplitude of 1.9 $V_{p\text{-}p}$ during the mutual ion storage period.

Ions derived from electrospray of cytochrome c are used to demonstrate ion parking illustrated in FIGS. 4*a-c*. FIG. 4*a*, for example, shows the electrospray mass spectrum of bovine cytochrome c before anions derived from glow discharge ionization of PDCH were admitted into the chamber of the ion trap (i.e., FIG. 4*a* represents the normal electrospray mass spectrum). This spectrum represents the condition illustrated in FIG. 3*a*. FIG. 4*b* shows the spectrum after anions of PDCH were admitted into the chamber of the ion trap for 3 ms and a mutual cation/anion storage time of 300 ms was used prior to anion ejection and subsequent mass analysis (i.e., the normal post-ion/ion reaction mass spectrum). In this case, the ion/ion reactions could proceed to the point at which the singly-protonated cytochrome c species was the most abundant post ion/ion reaction product cation. (Note that based on the relative abundances of the doubly-and singly-charged ions in FIG. 4*b* and the predicted abundances of FIG. 2, it is likely that a significant number of the cytochrome c ions are completely neutralized under the conditions used to acquire FIG. 4*b*. In fact, the extent of total neutralization is expected to be greater than that predicted on the basis of FIG. 2 because the efficiency of detection of the singly-charged ions is expected to be less than that of the doubly-charged ions.) The spectrum of FIG. 4*b* represents the condition illustrated in FIG. 3*b*. FIG. 4*c* shows the results of an experiment with ion/ion reaction conditions identical to those used to derive FIG. 4*b* except that the population of ions were exposed to a resonance excitation frequency during the charge-to-mass altering reaction between the cytochrome c ions and the PDCH ions, in particular, a single dipolar frequency of 15 kHz and 1.9 $V_{p-p}$, was applied to the end-cap electrodes of the ion trap during the entire ion/ion mutual storage period. This frequency is somewhat above that of the fundamental Z-dimension secular frequency of the cytochrome c +3 charge state ion (i.e., on the low mass-to-charge side of the peak). In this experiment, it is clear that the extent of proton transfer has been significantly reduced relative to the experiment leading to FIG. 4*b*. Furthermore, a much greater relative abundance of the +3 charge state is observed than is expected at any reaction time based on the predicted time evolution of the ion/ion reactions (FIG. 2). For example, significant abundances of both the +4 and +2 ions are expected when the +3 ion is most abundant in the absence of ion parking. By accelerating ions of the mass-to-charge ratio of the +3 charge state as they are formed, the ion/ion reaction rate for this charge state is significantly diminished thereby allowing the signal to be concentrated in this charge state. A small degree of further reaction to lower charge states is also observed and presumably occurs as a result of the finite time associated with acceleration of the newly formed +3 ion, and relatively slow reactions at the elevated average velocity of the +3 ion. Ion/ion reactions can also take place during the finite length of time (several milliseconds) used to eject the anions at the end of the mutual ion storage period.

Figure 5:
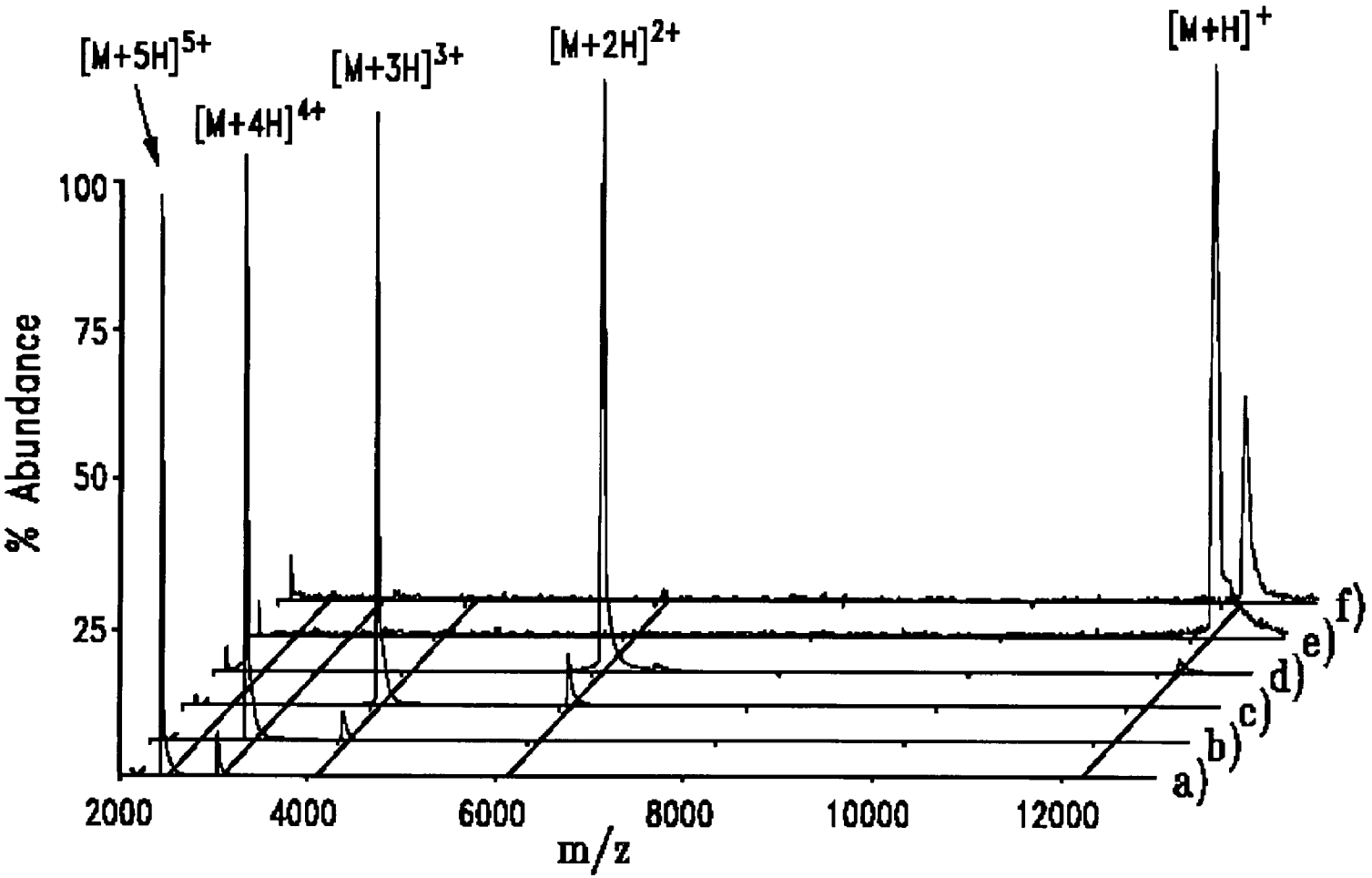
FIG. 5 is a series of post ion/ion reaction mass spectra (a-f) of bovine cytochrome c ions each acquired in an ion parking mode of the present invention.

Effective ion parking experiments have been demonstrated for all charge states of cytochrome c from +1 to +10. FIG. 5 summarizes the results for charge states +1 to +5. In all cases, significant concentration of signal in the ion for which the resonance excitation frequency was most closely tuned was observed. In the case of the +1 ion, while the relative abundance in the spectra are similar in comparing FIG. 4*b* with the relevant +1 ion parking trace of FIG. 5, the absolute abundance of the ion parking experiment shows an increase of over a factor of 2. This demonstrates that the acceleration of the +1 ion inhibits its reaction to the neutral state.

The extent to which further reactions are observed in an ion parking experiment for a given charge state depends upon the initial absolute rate of the reaction being inhibited. For example, reaction rates are highest at high charge states and with high numbers of oppositely-charged ions. In this situation, the likelihood for further reactions is maximized.

It should be understood that other ion parking experiments besides the one illustrated in FIG. 4 are contemplated. For example, sequential ion/ion reaction events with the population of ions being exposed to different resonance excitation frequencies in each step allows for a sequential ion parking experiment where ions initially parked in a relatively high charge state can be moved to a second (lower) charge state in a second ion parking period. This type of procedure might be described as, for example, a sequential ion parking experiment. Another example is the simultaneous exposure of the ion population to multiple resonance excitation frequencies in a single ion/ion reaction period to allow for several ions derived from molecules of different mass to be parked and selectively accumulated in the chamber of the ion trap simultaneously. In the case of the use of two different resonance excitation frequencies during the same ion/ion reaction period, the procedure might be referred to as, for example, a double parking experiment.

Figure 6:
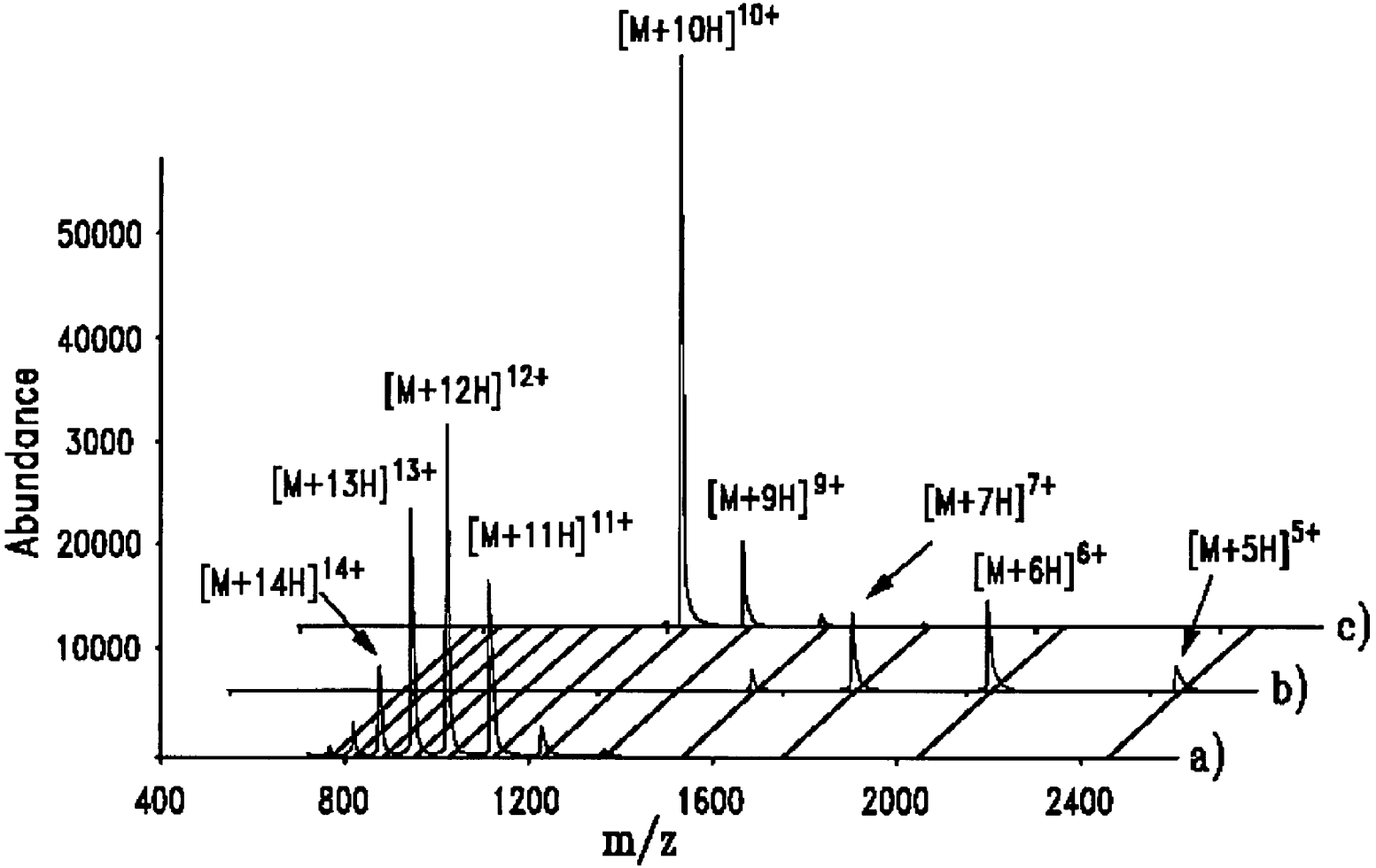
FIG. 6 is a series of mass spectra (a-c) of bovine cytochrome c ions, with (a) acquired in pre ion/ion mode, (b) acquired post ion/ion mode, and (c) acquired with an ion parking mode of the present invention (44,600 Hz resonance excitation frequency, and an amplitude of 1.25 $V_{p-p}$), using a resonance ejection frequency of 89,202 Hz and an amplitude of 9.8 $V_{p-p}$ (note that the anions were admitted into the ion trap for 1 ms and a mutual cation/anion storage time of 150 ms was used prior to anion ejection and subsequent mass analysis for both (b) and (c))

The experiments summarized in FIG. 6 may be used to obtain a semi-quantitative estimate of the efficiency of the ion parking procedure, defined as the fraction of the initial reactant ion population that can be accumulated in a specific charge state via the ion parking procedure of the present invention. FIG. 6*a* shows the pre-ion/ion electrospray mass spectrum of cytochrome c, FIG. 6*b* shows the post-ion/ion mass spectrum (no ion parking) after 1 ms anion accumulation period and a 150 ms mutual storage time period, and FIG. 6*c* shows the results using the same ion/ion reaction conditions with the ion population exposed to a resonance excitation frequency of 44,600 Hz, 1.25.$V_{p\text{-}p}$, This resonance excitation frequency corresponds to the high frequency side of the fundamental Z-dimension secular frequency (in the absence of anions) of the +10 cytochrome c ion. An estimate of the efficiency of the ion parking experiment was made by assuming the detector response to be linear with the charge state of the ion. After normalizing ion abundance according to the charge state, roughly 90% of the ions of FIG. 6*a* are accounted for in FIG. 6*c*. Of all of the product ions observed in FIG. 6*c*, roughly 83% are accounted for in the signal for the +10 ion, the remainder being accounted for by further reactions to give lower charge state products. This comparison suggests that under the conditions used for ion parking in these experiments, relatively few of the +10 ions are being ejected (or fragmented) such that a large fraction of the initial pre-ion/ion cation population (>70%, in this case) can be concentrated into the +10 charge state. This capability provides a way by which analyte ions normally distributed among a range of charge states can be concentrated largely into a single charge state. As noted above, the extent of reaction beyond the charge state undergoing ion parking is related to the ion/ion reaction rate of the ion being parked. Therefore, to minimize further reacting for this relatively high charge state, a short anion accumulation time (1 ms) was used.

The resolution and efficiency of the ion parking experiment for a given charge state ion are functions of the ion/ion reaction conditions (i.e., number of oppositely-charged ions and ion storage conditions) as well as the amplitude and frequency of the resonance excitation frequency. The simultaneous presence of oppositely-charged ions at the center of the ion trap can affect the resonance excitation behavior of the ions. This effect is most pronounced at high ion numbers and can have dramatic effects on mass analysis (Stephenson, Jr., J. L.; McLuckey, S. A. Anal. Chem. 1997, 69, 3760-3766 which is incorporated herein by reference) and ion parking. For example, when the density of one ion polarity greatly exceeds that of the other, the application of a resonance excitation frequency to ions of the lesser density is ineffective for ion parking. This is presumably due to the electric field arising from the presence of the high density ions. In the case of multiply-charged positive ions reacting with anions derived from glow discharge ionization of PDCH, a large excess of negative charge can be effected by the use of relatively long ion accumulation periods (e.g., tens of milliseconds in the present instrument configuration). However, even at anion numbers sufficiently low that resonance excitation is effective at ejecting cations, ion parking can be comprised as a result of high ion/ion reaction rates. For these reasons, it is desirable to use the minimum anion abundance necessary for charge state manipulation during an ion parking period. Another ion/ion reaction condition is the level of the radio-frequency voltage applied to the ring-electrode used to trap ions (V in equation 5). This level is often a compromise to accommodate the wide mass-to-charge range frequently required in ion/ion reaction experiments. This level also establishes the relationship between ion frequency and ion mass-to charge ratio (see equations (2), (3), and (5)). Of particular significance for an ion parking experiment is the fact that frequency dispersion (e.g., the difference in frequency between ions of adjacent unit mass-to-charge ratios) decreases as mass-to-charge increases and increases as the level of the radio-frequency voltage increases. The use of resonance excitation during an ion/ion reaction period does not allow for an independent optimization of the level of the radio-frequency voltage for ion/ion reactions and for resonance excitation.

As with any resonance excitation experiment, the effective bandwidth is directly related to the amplitude of the resonance excitation voltage. Therefore, the width of the range of mass-to-charge for which ion/ion reaction rates are affected by the resonance excitation frequency, which determines the effective resolution for ion parking, is inversely related to the amplitude of the resonance excitation voltage. However, it has been observed that high ion parking efficiencies (e.g.,>30%) require amplitudes of $\geqq 1.0\ V_{p\text{-}p}$ and resonance excitation frequencies of a few hundred Hz (either high or low) from the optimum frequency for resonance excitation, as judged by the point at which collision-induced dissociation efficiency is maximized in the absence of oppositely-charged ions. Several factors may play roles in giving rise to this observation. First, the relative influences of the electric fields associated with the oppositely-charged ions, on one hand, and the resonance excitation voltage on the other are expected to differ both with the number of ions and resonance excitation amplitude. Higher resonance excitation amplitudes are required when the space charge associated with the oppositely-charges ions in the center of the ion trap become significant. Furthermore, the relative velocity of the ion/ion collision pair is expected to increase with resonance excitation amplitude while the spatial overlap of the oppositely-charged ion clouds is expected to decrease. Therefore, relatively high resonance excitation amplitudes favor the excitation of a relatively large band-width of ions and also serves to minimize the ion/ion reaction rate. Good ion parking efficiencies can be observed under these conditions but at the expense of resolution.

Figure 7A:
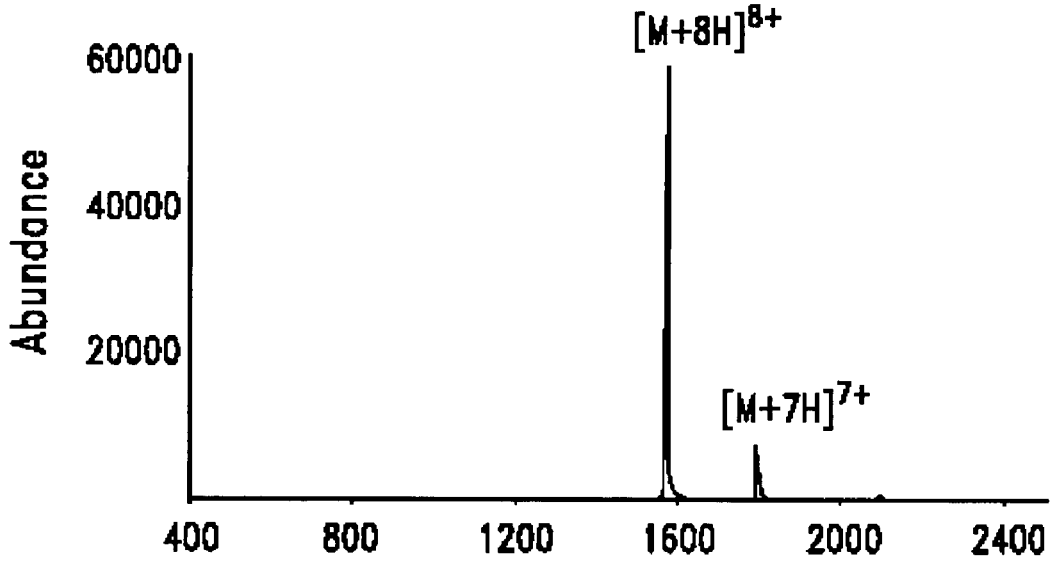
FIG. 7*a* is a mass spectrum of the $[M+8H]^{8+}$ ion of bovine cytochrome c acquired using a resonance ejection frequency of 89,202 Hz and an amplitude of 9.8 $V_{p-p}$ and an ion parking mode of the present invention utilizing a resonance excitation frequency of 36,200 Hz and an amplitude of 1.0 $V_{p-p}$ (note that anion injection and cation/anion storage periods were 1 ms and 300 ms, respectively)
Figure 7B:
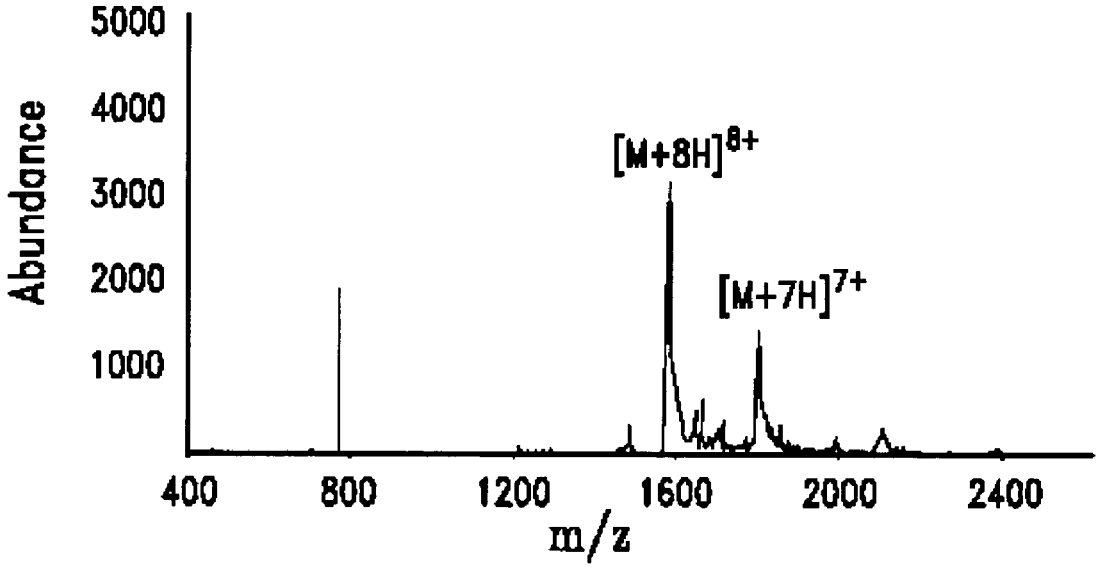
FIG. 7*b* is a mass spectrum of the $[M+8H]^{8+}$ ion of bovine cytochrome c acquired using a resonance ejection frequency of 89,202 Hz and an amplitude of 9.8 $V_{p-p}$ and an ion parking mode of the present invention utilizing a resonance excitation frequency of 36,000 Hz and an amplitude of 1.0 $V_{p-p}$ (note that anion injection and cation/anion storage periods were 1 ms and 300 ms, respectively)
Figure 7C:
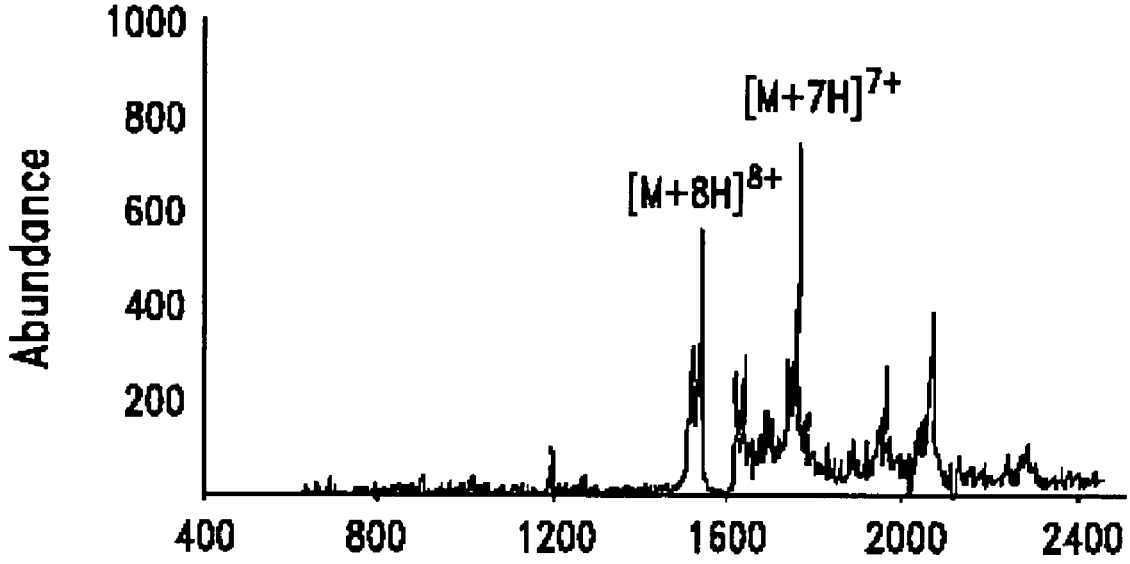
FIG. 7*c* is a mass spectrum of the $[M+8H]^{8+}$ ion of bovine cytochrome c acquired using a resonance ejection frequency of 89,202 Hz and an amplitude of 9.8 $V_{p-p}$ and an ion parking mode of the present invention utilizing a resonance excitation frequency of 34,500 Hz and an amplitude of 1.0 $V_{p-p}$ (note that anion injection and cation/anion storage periods were 1 ms and 300 ms, respectively)
Figure 7D:
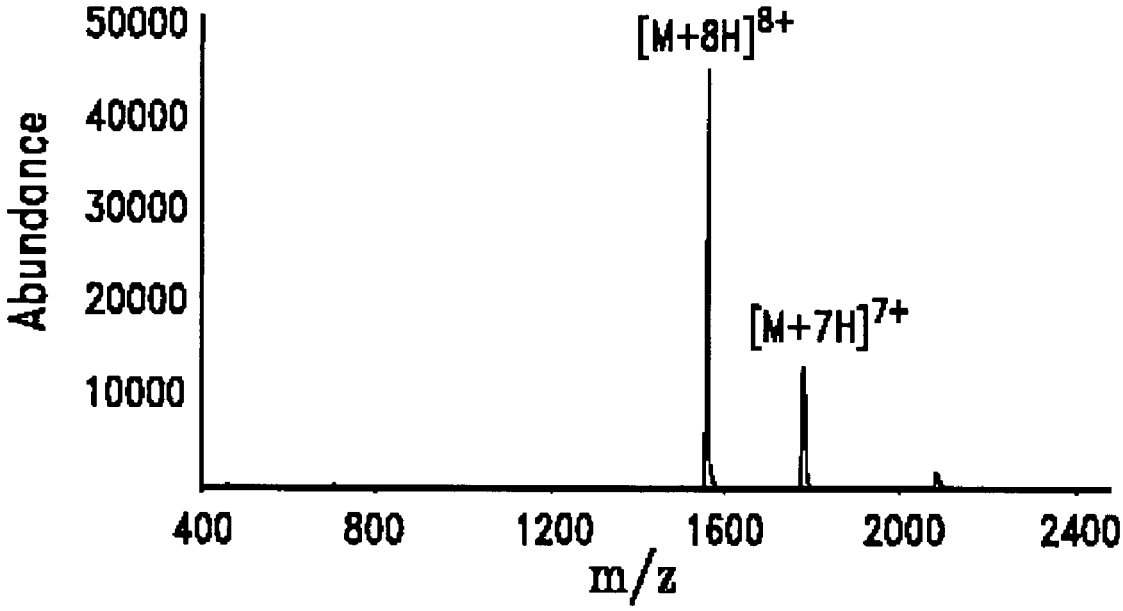
FIG. 7*d* is a mass spectrum of the $[M+8H]^{8+}$ ion of bovine cytochrome c acquired using a resonance ejection frequency of 89,202 Hz and an amplitude of 9.8 $V_{p-p}$ and an ion parking mode of the present invention utilizing a resonance excitation frequency of 34,200 Hz and an amplitude of 1.0 $V_{p-p}$ (note that anion injection and cation/anion storage periods were 1 ms and 300 ms, respectively)

The frequency dependence of the ion parking experiment using dipolar resonance excitation in an ion trap with a positive octopolar component (i.e., the ion trap electrode geometry of the Finnigan Ion Trap Mass Spectrometer; Syka, J. E. P. in "Practical Aspects of Ion Trap Mass Spectrometery, Vol. I: Fundamentals of Ion Trap Mass Spectrometry", R. E. March and J. F. J. Todd (Eds.), CRC Press, Chap. 4, 1995, 169-202 and Franzen, J.; Gabling, R.-H.; Schubert, M.; Wang, Y. in "Practical Aspects of Ion Trap Mass Spectrometry, Vol. I: Fundamentals of Ion Trap Mass Spectrometry", R. E. March and J. F. J. Todd (Eds.), CRC Press, Chap. 3, 1995, 52-167, both of which are incorporated herein by reference) is illustrated with the data of FIGS. 7*a-d*. A resonance excitation amplitude of 2.3 $V_{p-p}$ was stepped at 100 Hz increments across the +8 charge state of cytochrome c during an ion/ion reaction period of 300 ms (anion accumulation time=1 ms) and selected spectra are shown in FIGS. 7*a-d*. In particular, FIGS. 7*a-d* shows spectra recorded at four resonance excitation frequencies applied during the ion/ion reaction period. The normal Z-dimension fundamental secular frequency of the +8 charge state of cytochrome c under these storage conditions is 35,200 Hz, as determined from the frequency at which the maxim collision-induced dissociation efficiency was noted for the ion in the absence of anions. FIGS. 7*a-d* shows the results of ion parking experiments in which the resonance excitation frequencies were as follows: FIG. 7*a* 36,200 Hz, FIG. 7*b* 36,000 Hz, FIG. 7*c* 34,500 Hz, and FIG. 7*d* 34,200 Hz. Highest efficiencies are noted at 36,200 Hz and 34,200 Hz whereas the data at 36,000 Hz and 34,500 Hz both appear to reflect ion ejection and collision-induced dissociation associated with the resonance excitation signal. Good efficiencies could also be observed with resonance excitation amplitudes of as low as 1.0 $V_{p-p}$ and at frequencies somewhat closer to 35,200 Hz but much more extensive consecutive reactions to lower charge states were noted at all frequencies when lower resonance excitation amplitudes were used. Ion parking with relatively high efficiency could be effected using resonance excitation voltages at frequencies on either the high or low frequency sides of the fundamental Z-dimension secular frequency of the ion. Subtle differences in efficiency were noted in use of frequencies shifted to high versus low frequency sides of the parked ion, particularly at voltage levels of 2.5 $V_{p-p}$ and higher, with the use of higher frequencies giving somewhat greater efficiency. This may be due to the more rapid ion acceleration associated with excitation on the high frequency side than on the low frequency side for ions in a non-linear ion trap with positive octopolar character (Syka, J. E. P. in "Practical Aspects of Ion Trap Mass Spectrometry, Vol. I: Fundamentals of Ion Trap Mass Spectrometry", R. E. March and J. F. J. Todd (eds.), CRC Press, Chapter 4, 1995, 169-202, Franzen, J.; Gabling, R-H.; Schubert, M.; Wang, Y. in "Practical Aspects of Ion Trap Mass Spectrometry, Vol. I: Fundamentals of Ion Trap Mass Spectrometry", R. E. March and J. F. J. Todd (Eds.), CRC Press, Chapter 3, 1995, 52-167, Williams, J. D.; Cox, K. A.; Cooks, R. G.; McLuckey, S. A.; Hart, K. J.; Goeringer, D. E. Anal. Chem. 1994, 66, 725-729 all of which are incorporated herein by reference).

Figure 8A:
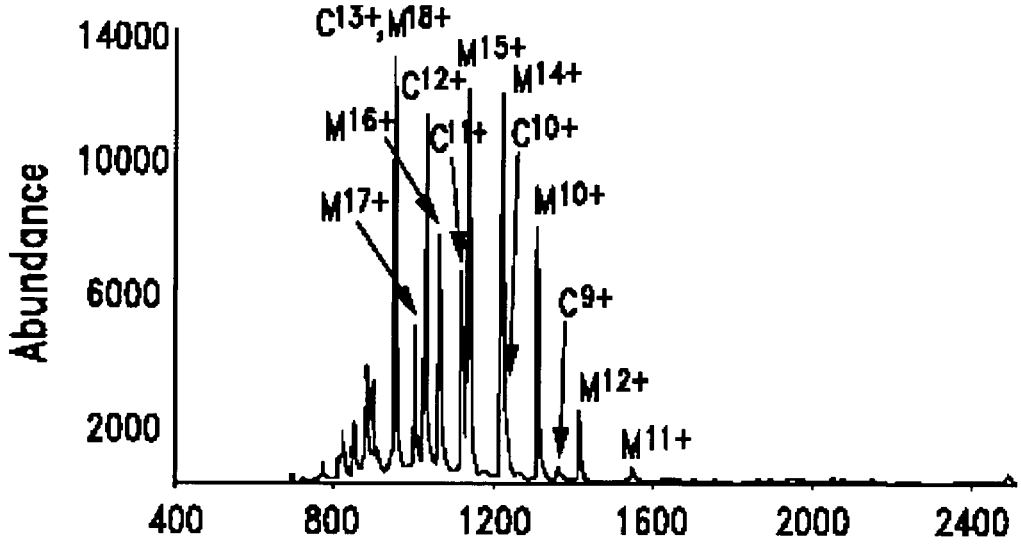
FIG. 8*a* is an electrospray mass spectrum of a 5 μM bovine cytochrome c and 5 μM horse heart apomyoglobin solution acquired in a pre ion/ion mode with a resonance ejection frequency of 89,202 Hz and an amplitude of 9.8 $V_{p-p}$.
Figure 8B:
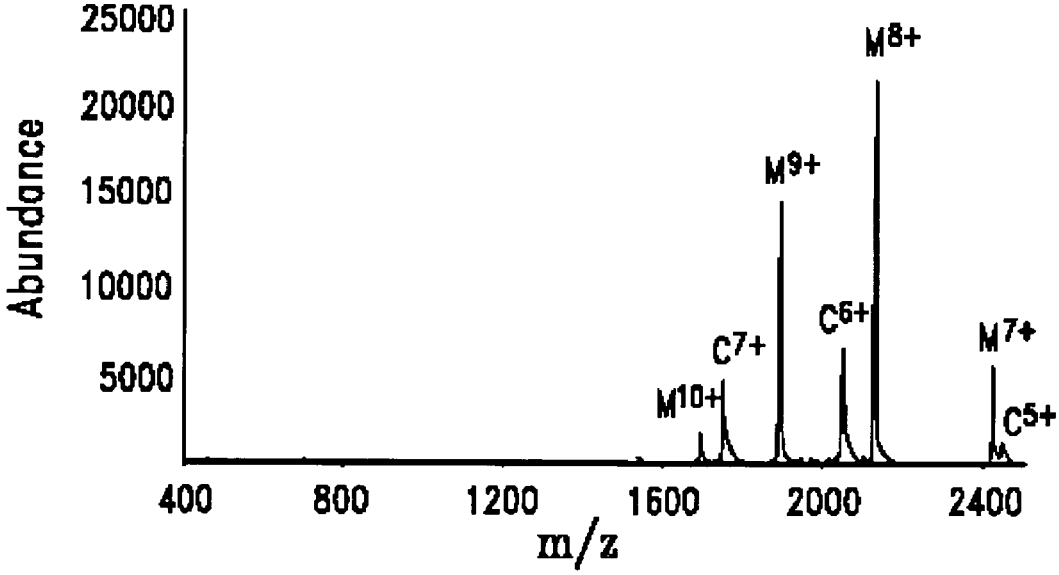
FIG. 8*b* is an electrospray mass spectrum of a 5 μM bovine cytochrome c and 5 μM horse heart apomyoglobin solution acquired in a post ion/ion mode with a resonance ejection frequency of 89,202 Hz and an amplitude of 9.8 $V_{p-p}$ (note that anion injection and cation/anion storage periods were 2 ms and 300 ms, respectively)
Figure 8C:
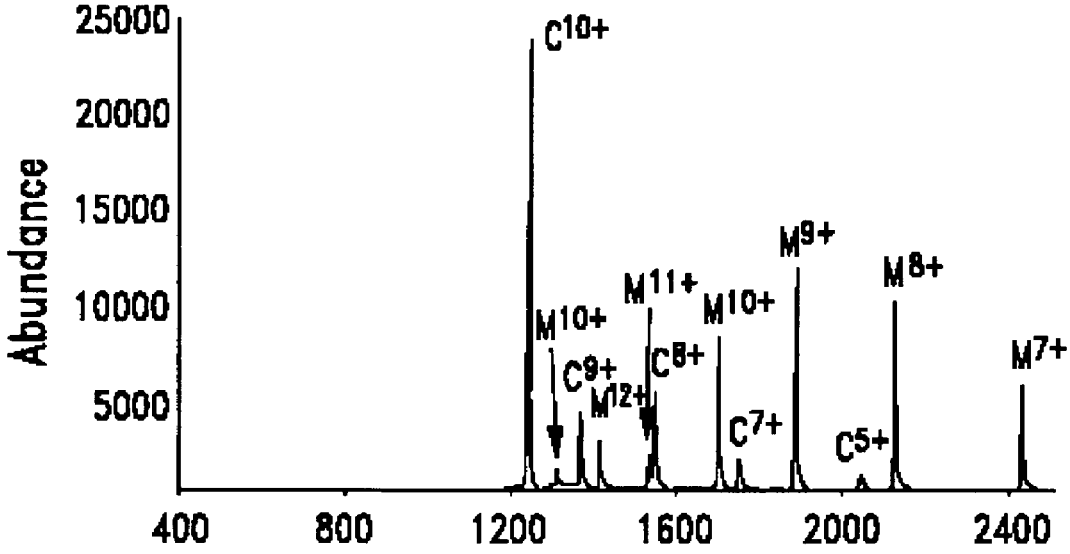
FIG. 8*c* is an electrospray mass spectrum of a 5 μM bovine cytochrome c and 5 μM horse heart apomyoglobin solution acquired with an ion parking mode of the present invention with a resonance excitation frequency of 42,900 Hz and an amplitude of 1.25 $V_{p-p}$ and a resonance ejection frequency of 89,202 Hz and an amplitude of 9.8 $V_{p-p}$ (note that anion injection and cation/anion storage periods were 2 ms and 300 ms, respectively)

It should be understood that a variety of experiments involving ion parking with or without other ion manipulation techniques available with ion trapping instruments are contemplated in dealing with the analysis of mixtures of ions derived from different compounds. The simplest involves a single ion parking resonance excitation frequency wherein only ions of a particular range of mass-to-charge ratios are accelerated to reduce ion/ion reaction rates while all other ions are allowed to react at relatively high rates. In this way, the non-parked ions can be moved to high mass-to-charge ratio. The spectra shown in FIGS. 8*a-c* illustrate this experiment. FIG. 8*a* shows the electrospray mass spectrum of an equimolar mixture of apomyoglobin and cytochrome c. FIG. 8*b* shows the post-ion/ion reaction mass spectrum (no ion parking) after an anion injected period of 2 ms and an ion/ion reaction period of 50 ms. FIG. 8*c* shows the post-ion/ion reaction mass spectrum using the same ion/ion reaction conditions as above except that a resonance excitation voltage of 1.25 $V_{p-p}$, 42,900 Hz was applied during the 50 ms ion/ion reaction period. This resonance excitation frequency, which is a few hundred Hz lower than that for on-resonance excitation of the +10 charge state of cytochrome c (m/z 1224.5), and amplitude leads to significantly greater acceleration of the +10 charge of cytochrome c than any other ion associated with the mixture. It is clear from FIG. 8*b* that in the absence of excitation, cytochrome c ions shift from a charge state range of +15-+9 to charge state range of +7-+5. Myoglobin ions shift from a charge state of +20-+11 to charge state range of +11-+7. (Lower charge states of myoglobin were also probably formed but fall beyond the mass-to-charge range analyzed in this experiment.) The resonance excitation voltage clearly leads to a major change in the post-ion/ion reaction mass spectrum. Much of the original cytochrome c ion population is concentrated in the +10 charge state. Smaller cytochrome c signals are observed in the +9-+6 charge states. These signals arise from cytochrome c ions of initially lower charge states than +10 and reactions of ions of the +10 charge state during the resonance excitation process. The ion/ion reaction rates of the +10 ion, however, are clearly reduced relative to non-resonance excitation condition 9 (i.e., the no ion parking experiment leading to FIG. 8*b*). The myoglobin ions, on the other hand, appear to be much less perturbed by the resonance excitation signal. A higher myoglobin charge state distribution is observed in FIG. 7*c* than in FIG. 7*b* which probably arises from off-resonance excitation of the +14 charge state and, to a lesser extent, the +13 charge state of myoglobin (m/z 1211.7 and m/z 1304.8, respectively). Such off-resonance power absorption for these ions could lead to a diminution of their ion/ion reaction rates but less than that experienced by the +10 ion of cytochrome c.

Figure 8D:
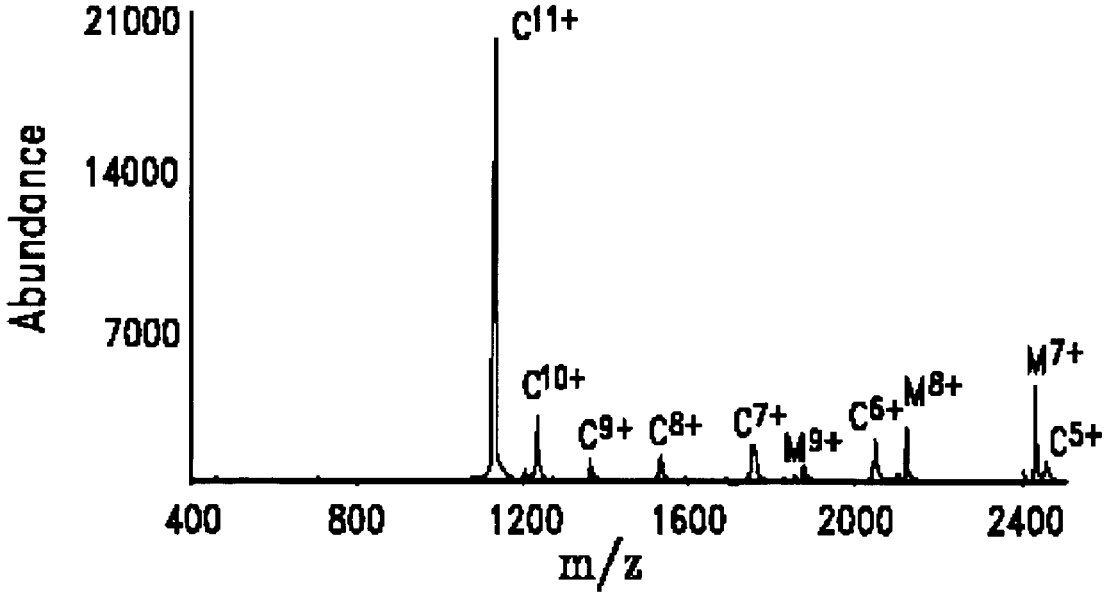
FIG. 8*d* is an electrospray mass spectrum of a 5 μM bovine cytochrome c and 5 μM horse heart apomyoglobin solution acquired with an ion parking mode of the present invention with a resonance excitation frequency of 47,100 Hz and an amplitude of 1.25 $V_{p-p}$ and a resonance ejection frequency of 89,202 Hz and an amplitude of 9.8 $V_{p-p}$ (note that anion injection and cation/anion storage periods were 2 ms and 300 ms, respectively)

An example of an experiment that combines more than one type of ion manipulation technique is the use of both resonance ejection, to remove ions of a particular predetermined range of mass-to-charge ratios, and resonance excitation, to park ions of a particular predetermined range of mass-to-charge ratios. This type of procedure can be effected by use of one or more resonance excitation frequencies. In the former case, however, it requires that the ions to be ejected and the ions to be parked be sufficiently spaced in mass-to-charge to allow for ejection (of one ion population) and parking (of a different ion population) to take place simultaneously. As an example of such a procedure using a single resonance excitation frequency is illustrated in FIG. 8*d* using the same mixture of myoglobin and cytochrome c discussed above. FIG. 8*d* shows the spectrum acquired after an identical ion/ion reaction period as that used to acquire FIGS. 8*b* and 8*c* except that a resonance excitation frequency of 47,100 Hz and amplitude of 1.25 $V_{p-p}$ was applied during the mutual ion storage period. This resonance excitation signal leads to ejection of the +16 charge state of myoglobin and parking of the +11 charge state of cytochrome c. This single resonance excitation frequency serves simultaneously to eject all myoglobin ions of charge states +16 and higher, since the highest charge states of myoglobin must fall into the +16 charge state before proceeding to lower charge states, and inhibits the ion/ion reaction rate of the +11 cytochrome c ions. The +10 charge state ions of cytochrome c are likely to arise from the fraction of +11 cytochrome c that undergo and additional ion/ion reaction and possibly from a small degree of parking arising from off-resonance power absorption from the applied resonance excitation voltage. The cytochrome c and myoglobin ions observed at lower charge states arise primarily from the original +10 and lower charge states of cytochrome c and the +15 and lower charge states of myoglobin. These ions are not subjected to either resonance ejection or parking and can therefore react with the stored anions. Lower charge states are observed in FIG. 8*d* and in FIG. 8*b* because less positive charge is available for reaction to consume negative charge in the combined ion ejection/ion parking experiment. When there are comparable numbers of positive and negative charges, the extent of charge state reduction of the multiply-charged ions is sensitive both to the numbers of anions and number of cations.

The data of FIG. 8*d* illustrates one approach to the removal of ions from one protein while retaining ions of the other protein. This example also shows that the point at which ion parking is carried out can be within the charge state envelope of the pre-ion/ion reaction charge state distribution. The example of FIG. 4, on the other hand, illustrates a case in which ion parking was used at a point well below the lowest charge state observed in the pre-ion/ion reaction condition.

The following examples illustrate ion parking of the present invention utilizing the above described adapted Hitachi model M-8000 ion trap mass spectrometer 78 (see FIG. 1*b*). In particular, ASGDI source 80 was evacuated to a pressure of approximately 2 mTorr by the Leybold D25B rotary vane pump. Potentials of +400 V, +400 V, +70 V, +70 V and +50 V were applied to plate 90 and lenses 116, 118, and 120, respectively, using the ORTEC model 556 3 kV and ORTEC model 710 1 kV quad bias power supplies. The pressure in cavity 86 was raised to about. 800 mtorr by the addition of head space vapors of perfluoro-1,3-dimethlycyclohexane (PDCH) via a Granvile Phillips (Boulder, Colo.) variable leak valve. The main vacuum chamber of spectrometer 78 was evacuated to a pressure of approximately $1\times10^{-4}$ Torr (corrected), and measured using a Granville Phillips micro-ion module mounted on the vacuum manifold via a 0.5 inch (1.27 cm) NPT to NW25 Kwik flange. Helium was admitted into chamber 128 to a gauge pressure of $1.2\times10^{-4}$ Torr (approximately one mTorr corrected pressure) to provide collisional cooling of ions in the ion trap.

For ion/ion reactions singly charged negative ions were formed by ASGDI source 80 from PDCH, by pulsing at a selected point during the experiment the voltage applied to aperture 94 via a DEI model PVX-4150 pulse generator under the control of a TTL level trigger signal generated by ion trap 82 (test point T2) and controlled by ion trap 82 software.

Mass analysis was performed via resonance ejection, at a frequency of 122 kHz. The application of resonance ejection frequencies for mass analysis at extended mass ranges was achieved using the firmware and software supplied with spectrometer 78.

For protein sample introduction by nanospray ionization, the standard "pepperpot" electrospray assembly was removed and the samples sprayed directly into the skimmer cone of the instrument. Nanospray was effected by loading 10 μL of sample solution into a drawn borosilicate glass capillary with a tip diameter of approximately 5-10 μm. The electrical connection to the solution was made by inserting a stainless steel wire through the back of the capillary. Typically, 1.0-1.2 kV was applied to the needle.

Bovine serum albumin (BSA) was utilized as the protein in this example. The BSA was purchased from Sigma (St. Louis, Mo.) and desalted in aqueous 1% acetic acid prior to analysis, using a PD-10 desalting column obtained from Amersham Pharmacia (Piscataway, N.J.).

Figure 9A:
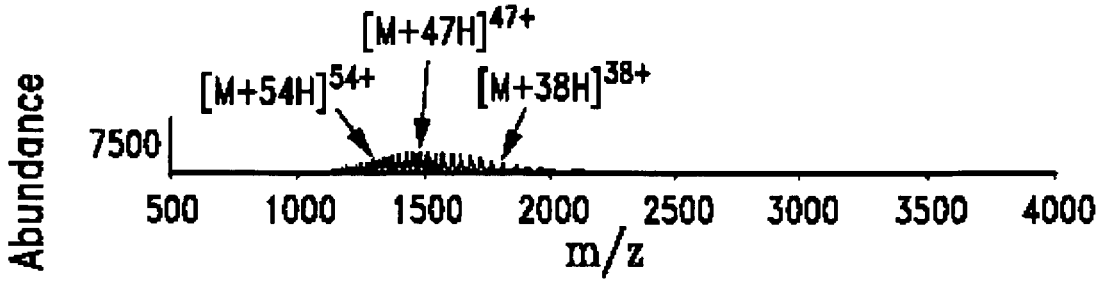
FIG. 9*a* is a mass spectrum of a 10 μM bovine serum albumin solution acquired in a pre ion/ion mode.
Figure 9B:
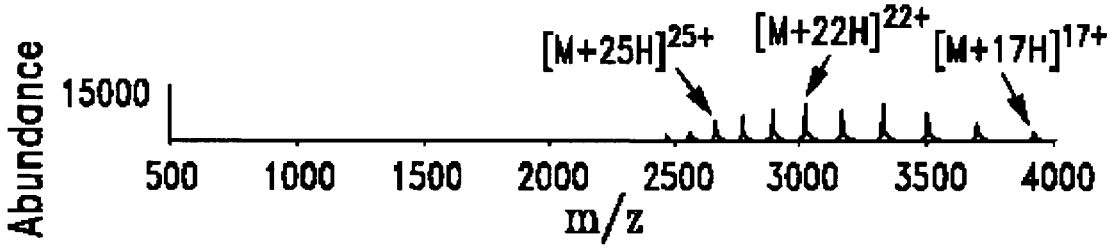
FIG. 9*b* is a mass spectrum of a 10 μM bovine serum albumin solution acquired in a post ion/ion mode.
Figure 9C:
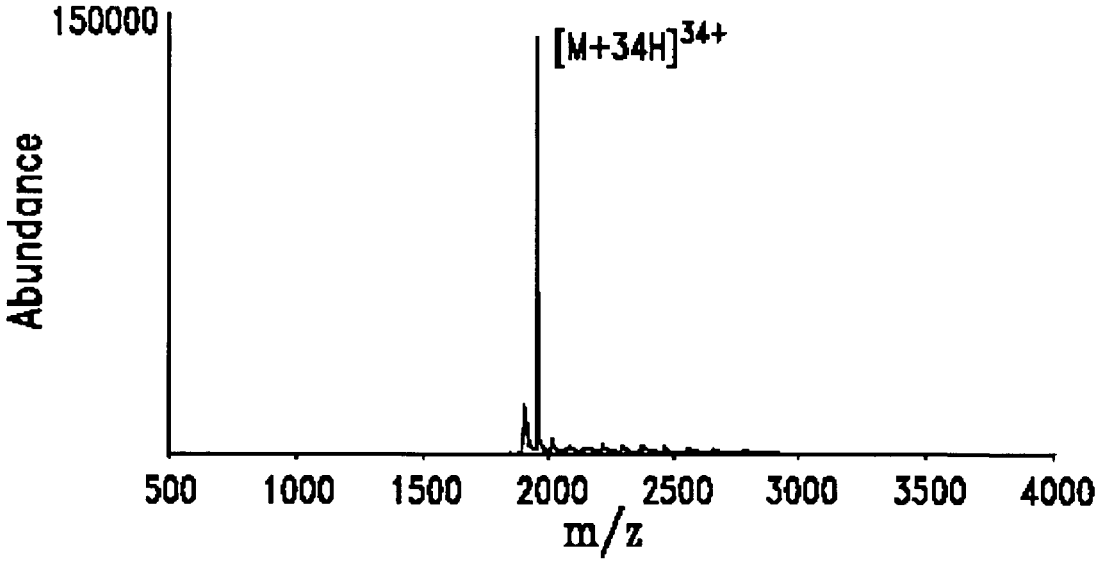
FIG. 9*c* is a mass spectrum of a 10 μM bovine serum albumin solution acquired with an ion parking mode of the present invention.

The mass spectrum obtained following introduction of the BSA sample at a concentration of 10 μM in 50:50:1 MeOH: $H_2O$:acetic acid by nanospray ionization is shown in FIG. 9*a*. Approximately 20 charge states of BSA, ranging from $[M+35H]^{35+}$ to $[M+59H]^{59+}$ were observed. Following ion/ion reactions for a short period of time (300 ms), in the absence of ion parking, the initial charge state distribution was reduced to approximately 10 charge states ranging from $[M+17H]^{17+}$ to $[M+27H]^{27+}$ (see FIG. 9*b*). As shown in FIG. 9*c*, upon application of a resonance excitation frequency of 18 kHz during the ion/ion reaction period however, effective ion parking of a single charge state ($[M+34H]^{34+}$) of BSA was observed. By normalizing the abundance scales between the three spectra, it can be estimated that almost quantitative concentration of the initial ion population into the +34 charge state was achieved.

As discussed above, the present invention provides methods for selectively diminishing rates of ion/ion reactions in a quadrupole ion trap via the acceleration of ions at mass-to-charge dependent frequencies of motion. The approach is effective when the electric field associated with the presence of the oppositely charged ion clouds is sufficiently small that it does not seriously affect the resonance excitation process. The efficiency of the process can be high with an efficiency of about 70%. A variety of applications of a method of the present invention are contemplated. For example, one involves the accumulation of a large majority of ions initially formed with a distribution of charge states into a single charge state. This is an attractive capability when, for example, it is desirable to acquire tandem mass spectrometry data. Another set of applications pertains to mixture analysis whereby the ion parking capability adds a new tool to the ion trap suite of ion isolation techniques.

While the invention has been illustrated and described in detail in the drawings and foregoing description, such illustration and description is to be considered as exemplary and not restrictive in character, it being understood that only a preferred embodiment has been shown and described and that all changes and modifications that come within the spirit of the invention are desired to be protected.

The invention claimed is:

1. A method of operating an ion trap, comprising:

(a) creating an ion trapping potential within a chamber of said ion trap with an electrode assembly of said ion trap;

(b) disposing a population of ions in an area defined by said ion trapping potential, wherein (i) said population of ions includes a first subpopulation of ions and a second subpopulation of ions, (ii) each ion of said first subpopulation of ions carries multiple charges, (iii) each ion of said first subpopulation of ions has a mass-to-charge ratio which is the same or different as other ions of said first subpopulation of ions such that ions of said first subpopulation of ions define a range of mass-to-charge ratios, and (iv) each ion of said second subpopulation of ions carries a charge which is opposite to a charge carried by each ion of said first subpopulation of ions;

(c) exposing said population of ions to a first resonance excitation frequency during a mass-to-charge altering reaction between said first subpopulation of ions and said second subpopulation of ions, said first resonance excitation frequency being tuned so that (i) when an ion of said first subpopulation of ions attains a first predetermined mass-to-charge ratio, said ion having said first predetermined mass-to-charge ratio is selectively inhibited from reacting with ions of said second subpopulation of ions and (ii) ions of said first subpopulation of ions having said first predetermined mass-to-charge ratio are selectively accumulated in said chamber of said ion trap during said exposure of said population of ions to said first resonance excitation frequency;

(d) stopping said exposure of said population of ions to said first resonance excitation frequency so that (i) ions which have attained said first predetermined mass-to-charge ratio are not inhibited from reacting with ions of said second subpopulation of ions and (ii) ions of said first subpopulation of ions which have said first predetermined mass-to-charge ratio react with ions of said second subpopulation of ions such that said first predetermined mass-to-charge ratio of ions of said first subpopulation of ions is altered; and (e) exposing said population of ions to a second resonance excitation frequency while ions of said first subpopulation of ions which have attained said first predetermined mass-to-charge ratio react with ions of said second subpopulation of ions, said second resonance excitation frequency being tuned so that (i) when an ion of said first subpopulation of ions attains a second predetermined mass-to-charge ratio, said ion having said second predetermined mass-to-charge ratio is selectively inhibited from reacting with ions of said second subpopulation of ions and (ii) ions of said first subpopulation of ions having said second predetermined mass-to-charge ratio are selectively accumulated in said chamber of said ion trap during said exposure of said population of ions to said second resonance excitation frequency.

2. A method of operating an ion trap, comprising:

(a) creating an ion trapping potential within a chamber of said ion trap with an electrode assembly of said ion trap;

(b) disposing a population of ions in an area defined by said ion trapping potential, wherein (i) said population of ions includes a first subpopulation of ions and a second subpopulation of ions, (ii) each ion of said first subpopulation of ions carries multiple charges, (iii) each ion of said first subpopulation of ions has a mass-to-charge ratio which is the same or different as other ions of said first subpopulation of ions such that ions of said first subpopulation of ions define a range of mass-to-charge ratios, and (iv) each ion of said second subpopulation of ions carries a charge which is opposite to a charge carried by each ion of said first subpopulation of ions;

(c) exposing said population of ions to a first resonance excitation frequency during a mass-to-charge altering reaction between said first subpopulation of ions and said second subpopulation of ions, said first resonance excitation frequency being tuned so that (i) when an ion of said first subpopulation of ions attains a first predetermined mass-to-charge ratio, said ion having said first predetermined mass-to-charge ratio is selectively inhibited from reacting with ions of said second subpopulation of ions and (ii) ions of said first subpopulation of ions having said first predetermined mass-to-charge ratio are selectively accumulated in said chamber of said ion trap during said exposure of said population of ions to said first resonance excitation frequency; and (d) during (c) exposing said population of ions to a second resonance excitation frequency, said second resonance excitation frequency being tuned so that (i) when an ion of said first subpopulation of ions attains a second predetermined mass-to-charge ratio, said ion having said second predetermined mass-to-charge ratio is selectively inhibited from reacting with ions of said second subpopulation of ions and (ii) ions of said first subpopulation of ions having said second predetermined mass-to-charge ratio are selectively accumulated in said chamber of said ion trap during said exposure of said population of ions to said second resonance excitation frequency.

3. A method of operating an ion trap, comprising:

(a) disposing a population of ions in an area defined by an ion trapping potential positioned within a chamber of said ion trap, wherein (i) said population of ions includes a first subpopulation of ions and a second subpopulation of ions, (ii) each ion of said first subpopulation of ions carries multiple charges, (iii) each ion of said first subpopulation of ions has a mass-to-charge ratio which is the same or different as other ions of said first subpopulation of ions such that ions of said first subpopulation of ions define a range of mass-to-charge ratios, and (iv) each ion of said second subpopulation of ions carries a charge which is opposite to a charge carried by each ion of said first subpopulation of ions;

(b) applying a voltage to an electrode of said ion trap so as to generate a first excitation resonance frequency;

(c) exposing said population of ions to said first resonance excitation frequency during a mass-to-charge altering reaction between said first subpopulation of ions and said second subpopulation of ions, said first resonance excitation frequency being tuned so that (i) when an ion of said first subpopulation of ions attains a first predetermined mass-to-charge ratio, said ion having said first predetermined mass-to-charge ratio is selectively inhibited from reacting with ions of said second subpopulation of ions and (ii) ions of said first subpopulation of ions having said first predetermined mass-to-charge ratio are selectively accumulated in said chamber of said ion trap during said exposure of said population of ions to said first resonance excitation frequency;

(d) stopping said exposure of said population of ions to said first resonance excitation frequency so that (i) ions which have attained said first predetermined mass-to-charge ratio are not inhibited from reacting with ions of said second subpopulation of ions and (ii) ions of said first subpopulation of ions which have said first predetermined mass-to-charge ratio react with ions of said second subpopulation of ions such that said first predetermined mass-to-charge ratio of ions of said first subpopulation of ions is altered; and (e) exposing said population of ions to a second resonance excitation frequency while ions of said first subpopulation of ions which have attained said first predetermined mass-to-charge ratio react with ions of said second subpopulation of ions, said second resonance excitation frequency being tuned so that (i) when an ion of said first subpopulation of ions attains a second predetermined mass-to-charge ratio, said ion having said second predetermined mass-to-charge ratio is selectively inhibited from reacting with ions of said second subpopulation of ions and (ii) ions of said first subpopulation of ions having said second predetermined mass-to-charge ratio are selectively accumulated in said chamber of said ion trap during said exposure of said population of ions to said second resonance excitation frequency.

4. A method of operating an ion trap, comprising:

(a) disposing a population of ions in an area defined by an ion trapping potential positioned within a chamber of said ion trap, wherein (i) said population of ions includes a first subpopulation of ions and a second subpopulation of ions, (ii) each ion of said first subpopulation of ions carries multiple charges, (iii) each ion of said first subpopulation of ions has a mass-to-charge ratio which is the same or different as other ions of said first subpopulation of ions such that ions of said first subpopulation of ions define a range of mass-to-charge ratios, and (iv) each ion of said second subpopulation of ions carries a charge which is opposite to a charge carried by each ion of said first subpopulation of ions;

(b) applying a voltage to an electrode of said ion trap so as to generate a first excitation resonance frequency;

(c) exposing said population of ions to said first resonance excitation frequency during a mass-to-charge altering reaction between said first subpopulation of ions and said second subpopulation of ions, said first resonance excitation frequency being tuned so that (i) when an ion of said first subpopulation of ions attains a first predetermined mass-to-charge ratio, said ion having said first predetermined mass-to-charge ratio is selectively inhibited from reacting with ions of said second subpopulation of ions and (ii) ions of said first subpopulation of ions having said first predetermined mass-to-charge ratio are selectively accumulated in said chamber of said ion trap during said exposure of said population of ions to said first resonance excitation frequency; and (d) during (c) exposing said population of ions to a second resonance excitation frequency, said second resonance excitation frequency being tuned so that (i) when an ion of said first subpopulation of ions attains a second predetermined mass-to-charge ratio, said ion having said second predetermined mass-to-charge ratio is selectively inhibited from reacting with ions of said second subpopulation of ions and (ii) ions of said first subpopulation of ions having said second predetermined mass-to-charge ratio are selectively accumulated in said chamber of said ion trap during said exposure of said population of ions to said second resonance excitation frequency.

5. A method of inhibiting a reaction between ions, comprising:

(a) disposing a population of ions in an area defined by an ion trapping potential, wherein (i) said population of ions includes a first subpopulation of ions and a second subpopulation of ions, (ii) each ion of said first subpopulation of ions carries multiple charges, (iii) each ion of said first subpopulation of ions has a mass-to-charge ratio which is the same or different as other ions of said first subpopulation of ions such that ions of said first subpopulation of ions define a range of mass-to-charge ratios, and (iv) each ion of said second subpopulation of ions carries a charge which is opposite to a charge carried by each ion of said first subpopulation of ions; and (b) simultaneously exposing said population of ions to a first resonance excitation frequency and a second resonance excitation frequency during a mass-to-charge altering reaction between said first subpopulation of ions and said second subpopulation of ions, said first resonance excitation frequency being tuned so that (i) when an ion of said first subpopulation of ions attains a first predetermined mass-to-charge ratio, said ion having said first predetermined mass-to-charge ratio is selectively inhibited from reacting with ions of said second subpopulation of ions and (ii) ions of said first subpopulation of ions having said first predetermined mass-to-charge ratio are selectively accumulated during said exposure of said population of ions to said first resonance excitation frequency, and said second resonance excitation frequency being tuned so that (i) when an ion of said first subpopulation of ions attains a second predetermined mass-to-charge ratio, said ion having said second predetermined mass-to-charge ratio is selectively inhibited from reacting with ions of said second subpopulation of ions and (ii) ions of said first subpopulation of ions having said second predetermined mass-to-charge ratio are selectively accumulated during said exposure of said population of ions to said second resonance excitation frequency.

* * * * *

UNITED STATES PATENT AND TRADEMARK OFFICE

CERTIFICATE OF CORRECTION

PATENT NO. : 7,355,169 B2
APPLICATION NO. : 11/418907
DATED : April 8, 2008
INVENTOR(S) : McLuckey et al.

It is certified that error appears in the above-identified patent and that said Letters Patent is hereby corrected as shown below:

In the Specification

In column 1, lines 17-20, delete the paragraph under "GOVERNMENT RIGHTS" and replace it with:

"This invention was made with government support under Grant No. GM 45372 awarded by the National Institutes for Health. The government has certain rights in the invention."

Signed and Sealed this
Twenty-fourth Day of February, 2015

Michelle K. Lee

Michelle K. Lee
*Deputy Director of the United States Patent and Trademark Office*